US008327661B2

(12) United States Patent
Fujimoto et al.

(10) Patent No.: US 8,327,661 B2
(45) Date of Patent: Dec. 11, 2012

(54) REFRIGERATION APPARATUS

(75) Inventors: Shuji Fujimoto, Sakai (JP); Atsushi Yoshimi, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 393 days.

(21) Appl. No.: 12/744,439

(22) PCT Filed: Nov. 26, 2008

(86) PCT No.: PCT/JP2008/071371

§ 371 (c)(1),
(2), (4) Date: May 24, 2010

(87) PCT Pub. No.: WO2009/069611

PCT Pub. Date: Jun. 4, 2009

(65) Prior Publication Data

US 2010/0257894 A1 Oct. 14, 2010

(30) Foreign Application Priority Data

Nov. 30, 2007 (JP) ..... 2007-311689

(51) Int. Cl.
*F25B 1/10* (2006.01)

(52) U.S. Cl. ..... 62/510; 62/513

(58) Field of Classification Search ..... 62/510, 62/513, 498, 500, 159, 160, 238.7, 324.1, 62/228.3, 196.1, 197; 417/243, 244, 245
See application file for complete search history.

(56) References Cited

U.S. PATENT DOCUMENTS 3,680,973 A * 8/1972 Pilarczyk ..... 415/58.1
3,719,057 A * 3/1973 Grant ..... 62/193
4,660,384 A * 4/1987 Pallanch ..... 62/81
4,947,655 A * 8/1990 Shaw ..... 62/200
5,150,581 A * 9/1992 Smith ..... 62/115
5,769,610 A * 6/1998 Paul et al. ..... 417/228
7,028,491 B2 * 4/2006 Horton ..... 62/158
7,096,679 B2 * 8/2006 Manole ..... 62/115

(Continued)

FOREIGN PATENT DOCUMENTS

JP 57-120972 7/1982

(Continued)

OTHER PUBLICATIONS

International Preliminary Report of corresponding PCT Application No. PCT/JP2008/071362.

(Continued)

*Primary Examiner* — Mohammad Ali
(74) *Attorney, Agent, or Firm* — Global IP Counselors

(57) ABSTRACT

A refrigeration apparatus uses a refrigerant that operates in a region including critical processes, and includes a compression mechanism having first and second compressors, a heat-source-side heat exchanger, an expansion mechanism, a utilization-side heat exchanger, an intercooler, and an intermediate refrigerant pipe. The first compressor has a first low-pressure compression element and a first high-pressure compression element to increase pressure of refrigerant more than the first low-pressure compression element. The second compressor has a second low-pressure compression element and a second high-pressure compression element to increase pressure of refrigerant more than the second low-pressure compression element. The intermediate refrigerant pipe causes refrigerant discharged by the first and second low-pressure compression elements to pass through the intercooler and be sucked into first and second high-pressure the compression elements. The intake sides of the first and second low-pressure compression elements are connected. The discharge sides of the first and second high-pressure compression elements merge.

20 Claims, 6 Drawing Sheets

U.S. PATENT DOCUMENTS

| | | | | |
|---|---|---|---|---|
| 7,131,294 | B2 * | 11/2006 | Manole | 62/513 |
| 7,331,196 | B2 * | 2/2008 | Itsuki et al. | 62/510 |
| 7,631,510 | B2 * | 12/2009 | Radermacher et al. | 62/196.2 |
| 7,721,569 | B2 * | 5/2010 | Manole | 62/513 |
| 2002/0014088 | A1 * | 2/2002 | Seki et al. | 62/498 |
| 2003/0177782 | A1 * | 9/2003 | Gopalnarayanan et al. | 62/505 |
| 2005/0115260 | A1 * | 6/2005 | Yap | 62/238.6 |
| 2005/0132729 | A1 * | 6/2005 | Manole | 62/149 |
| 2005/0279127 | A1 * | 12/2005 | Jia et al. | 62/510 |
| 2006/0083626 | A1 * | 4/2006 | Manole | 417/245 |
| 2006/0083627 | A1 * | 4/2006 | Manole | 417/245 |
| 2006/0086110 | A1 * | 4/2006 | Manole | 62/175 |
| 2007/0000281 | A1 * | 1/2007 | Manole | 62/513 |
| 2009/0044564 | A1 | 2/2009 | Okamoto | |
| 2009/0301109 | A1 * | 12/2009 | Manole | 62/79 |

FOREIGN PATENT DOCUMENTS

| | | | |
|---|---|---|---|
| JP | 2004-278824 | A | 10/2004 |
| JP | 2007-232263 | A | 9/2007 |

OTHER PUBLICATIONS

International Search Report of corresponding PCT Application No. PCT/JP2008/071371.

* cited by examiner

REFRIGERATION APPARATUS

CROSS-REFERENCE TO RELATED APPLICATIONS

This U.S. National stage application claims priority under 35 U.S.C. §119(a) to Japanese Patent Application No. 2007-311689, filed in Japan on Nov. 30, 2007, the entire contents of which are hereby incorporated herein by reference.

TECHNICAL FIELD

The present invention relates to a refrigeration apparatus, and particularly relates to a refrigeration apparatus which carries out a multistage compression refrigeration cycle using a refrigerant that operates in a region including critical processes.

BACKGROUND ART

As one conventional example of a refrigeration apparatus which has a refrigerant circuit configured to be capable of switching between a cooling operation and a heating operation and which performs a multistage compression refrigeration cycle by using a refrigerant that operates in a critical range, Japanese Laid-open Patent Application No. 2007-232263 discloses an air-conditioning apparatus which has a refrigerant circuit configured to be capable of switching between an air-cooling operation and an air-warming operation and which performs a two-stage compression refrigeration cycle by using carbon dioxide as a refrigerant. This air-conditioning apparatus has primarily a compressor having two compression elements connected in series, a four-way switching valve for switching between an air-cooling operation and an air-warming operation, an outdoor heat exchanger, an expansion valve, and an indoor heat exchanger.

SUMMARY DISCLOSURE OF THE INVENTION

Technical Problem

In the air-conditioning apparatus described above, the critical temperature (approximately 31° C.) of carbon dioxide used as the refrigerant is about the same as the temperature of water or air as the cooling source of an outdoor heat exchanger or indoor heat exchanger functioning as a refrigerant cooler, which is low compared to R22, R410A, and other refrigerants, and the apparatus therefore operates in a state in which the high pressure of the refrigeration cycle is higher than the critical pressure of the refrigerant so that the refrigerant can be cooled by the water or air in these heat exchangers. As a result, since the refrigerant discharged from the second-stage compression element of the compressor has a high temperature, there is a large difference in temperature between the refrigerant and the water or air as a cooling source in the outdoor heat exchanger functioning as a refrigerant cooler, and the outdoor heat exchanger has much heat radiation loss, which poses a problem in making it difficult to achieve a high operating efficiency.

Furthermore, with the air-conditioning apparatus described above, since there is only one compressor, the degree of freedom for adjusting the flow rate of circulated refrigerant will be limited. Even if several compressors are provided in order to obtain a degree of freedom for adjusting the flow rate of circulated refrigerant, the size of the apparatus is liable to increase. Accordingly, there is a need to avoid further increasing the size of the apparatus when devices are provided for improving operating efficiency.

An object of the present invention is to provide a refrigeration apparatus that is capable of increasing the degree of freedom for adjusting the flow rate of refrigerant circulated by multistage compression-type compression elements, and that can improve the operating efficiency while suppressing an increase in the size of the apparatus in a refrigeration apparatus using a refrigerant that operates in a region including critical processes.

Solution to Problem

A refrigeration apparatus according to a first aspect of the present invention is a refrigeration apparatus which uses refrigerant that that operates with inclusion of processes of a critical state, the refrigeration apparatus comprising a compression mechanism, a heat-source-side heat exchanger, an expansion mechanism, a utilization-side heat exchanger, an intercooler, and an intermediate cooling pipe. The compression mechanism include a first compressor having a first low-pressure compression element for increasing the pressure of the refrigerant and a first high-pressure compression element for increasing the pressure of the refrigerant more than the first low-pressure compression element, and a second compressor having a second low-pressure compression element for increasing the pressure of the refrigerant and a second high-pressure compression element for increasing the pressure of the refrigerant more than the second low-pressure compression element. The heat-source-side heat exchanger functions as a heater or a cooler of the refrigerant. The expansion mechanism decompresses the refrigerant. The utilization-side heat exchanger functions as a heater or a cooler of the refrigerant. The intercooler cools the refrigerant that passes therethrough. The intermediate refrigerant pipe causes the refrigerant discharged from the first low-pressure compression element and the refrigerant discharged from the second low-pressure compression element to be sucked into the first high-pressure compression element and the second high-pressure compression element via the intermediate refrigerant pipe. The intake side of the second low-pressure compression element and the intake side of the first low-pressure compression element of the first compressor are connected. The discharge side of the second high-pressure compression element and the discharge side of the first high-pressure compression element of the first compressor merge together. As used herein, the term "compression mechanism" refers to a compressor in which a plurality of compression elements is integrally incorporated, or a configuration that includes a compressor in which a single compression element is incorporated and/or a plurality of compressors in which a plurality of compression elements has been incorporated are connected together.

With this refrigeration apparatus, a second compressor is provided in addition to a first compressor as multistage compression-type compression elements. Thereby the degree of freedom for adjusting the refrigerant circulation rate can be increased.

With the first compressor, the refrigerant discharged from the first low-pressure compression element passes through the intercooler prior to arriving at the first high-pressure compression element. The refrigerant discharged from the first low-pressure compression element is cooled when it passes through the intercooler. Accordingly, the temperature of the refrigerant sucked into the first high-pressure compression element is reduced. Therefore, the temperature of the refrigerant discharged from the first compression element can finally be kept lower in comparison with when such an intercooler is not provided. The operation efficiency of the first compressor can thereby be improved because the refrigerant density is improved by reducing the temperature of the refrigerant.

Similarly, with the second compressor as well, the refrigerant discharged from the second low-pressure compression element passes through the intercooler prior to arriving at the second high-pressure compression element. The refrigerant discharged from the second low-pressure compression element is cooled when it passes through the intercooler. Accordingly, the temperature of the refrigerant sucked into the second high-pressure compression element is reduced. Therefore, the temperature of the refrigerant discharged from the second compression element can finally be kept lower in comparison with when such an intercooler is not provided. The operation efficiency of the second compressor can thereby be improved because the refrigerant density is improved by reducing the temperature of the refrigerant.

Here, the intercooler can also cool the portion that extends from the second low-pressure compression element of the second compressor to the second high-pressure compression element in addition to cooling the portion that extends from the first low-pressure compression element of the first compressor to the first high-pressure compression element. Accordingly, space can be saved in comparison with when an intercooler is separately provided to each of the compressors, i.e., the first compressor and the second compressor.

The degree of freedom for adjusting the refrigerant circulation rate by multistage compression-type compression elements can be increased and the operation efficiency can be improved while keeping the size of the apparatus from increasing in a refrigeration apparatus using a refrigerant that operates in a region including critical processes.

During cooling operation, the temperature of the refrigerant discharged from the compression element is kept low due to the cooling effect of the intercooler. Thereby loss from heat dissipation can be reduced in the heat-source-side heat exchanger which functions as a refrigerant cooler, and the operation efficiency can be improved.

A refrigeration apparatus according to a second aspect of the present invention is the refrigerant apparatus according to the first aspect, and further comprises a merging circuit and a branching circuit. The merging circuit is a circuit for merging and directing the refrigerant discharged from the first low-pressure compression element and the refrigerant discharged from the second low-pressure compression element to the intercooler. The branching circuit is a circuit for branching and directing the refrigerant that has passed through the intercooler to the first high-pressure compression element and the second high-pressure compression element. Here, the first compression element may be provided with a first high-pressure compression element and a first low-pressure compression element, and it is also possible to dispose a plurality of compression elements as intermediate compression elements or the like for compressing the refrigerant at a midway point in the first compression element or the first high-pressure compression element.

In this refrigeration apparatus, there is a shared portion in which the refrigerant discharged from the first low-pressure compression element merges with the refrigerant discharged from the second low-pressure compression element. Accordingly, the intercooler can cool only the shared portion, and there is no need to provide a configuration for separately cooling the refrigerant discharged from the first low-pressure compression element and the refrigerant discharged from the second low-pressure compression element.

A refrigeration apparatus according to a third aspect of the present invention is the refrigerant apparatus according to the first aspect, and further comprises a first intermediate refrigerant pipe and a second intermediate refrigerant pipe. The first intermediate refrigerant pipe causes the refrigerant discharged from the first low-pressure compression element to pass through the intercooler and to be sucked into the first high-pressure compression element. The second intermediate refrigerant pipe causes the refrigerant discharged from the second low-pressure compression element to pass through the intercooler and to be sucked into the second high-pressure compression element.

In this refrigeration apparatus, the space inside the first intermediate cooling pipe and the space inside the second intermediate cooling pipe are discontinuous. Accordingly, the intermediate cooling part can separately cool the refrigeration compressed by the first compressor and the refrigerant compressed by the second compressor.

A refrigeration apparatus according to a fourth aspect of the present invention is the refrigerant apparatus according to the first aspect, and further comprises a first cross refrigerant pipe and a second cross refrigerant pipe. The first cross refrigerant pipe causes the refrigerant discharged from the first low-pressure compression element to flow through the intercooler and to be sucked into the second high-pressure compression element. The second cross refrigerant pipe causes the refrigerant discharged from the second low-pressure compression element to flow through the intercooler and to be sucked into the first high-pressure compression element.

With this refrigeration apparatus, the refrigerant can be made to flow between the first compressor and the second compressor by providing a first cross refrigerant pipe and a second cross refrigerant pipe.

A refrigeration apparatus according to a fifth aspect of the present invention is the refrigerant apparatus according to any of the first through fourth aspects, wherein the first high-pressure compression element, the first low-pressure compression element, the second high-pressure compression element, and the second low-pressure compression element have rotating shafts that are rotatably driven to carry out compression work. At least the rotating shaft of the first high-pressure compression element and the rotating shaft of the first low-pressure compression element are shared, or the rotating shaft of the second high-pressure compression element and the rotating shaft of the second low-pressure compression element are shared.

In this refrigeration apparatus, at least one of the following embodiments is adopted: the rotating shaft of the first high-pressure compression element and the rotating shaft of the first low-pressure compression element are shared, or the rotating shaft of the second high-pressure compression element and the rotating shaft of the second low-pressure compression element are shared. Accordingly, at least one of the following effects can be obtained. The rotating shaft of the first high-pressure compression element and the rotating shaft of the first low-pressure compression element can both be driven by a single drive force, or the rotating shaft of the second high-pressure compression element and the rotating shaft of the second low-pressure compression element can both be driven by a single drive force.

A refrigeration apparatus according to a sixth aspect of the present invention is the refrigerant apparatus according to any of the first through fifth aspects, and further comprises an injection pipe. The injection pipe branches off the refrigerant fed from the heat-source-side heat exchanger or the utilization-side heat exchanger to the expansion mechanism, and directs the refrigerant to the first high-pressure compression element and/or the second high-pressure compression element.

With this refrigeration apparatus, refrigerant is directed from the injection pipe to the first high-pressure compression element and/or the second high-pressure compression element, whereby heat can be transferred within a closed refrigeration cycle without discarding the heat to the exterior. Accordingly, the refrigerant sucked into the first high-pressure compression element and/or the second high-pressure compression element can be cooled, and the temperature of the refrigerant discharged from the compression mechanism can more reliably kept low.

During cooling operation, the temperature of the refrigerant discharged from the compression mechanism can be kept even lower by the cooling effect of the intercooler and by the refrigerant directed to the first high-pressure compression element and/or the second high-pressure compression element by the injection pipe. Thereby loss from heat dissipation can be reduced in the heat-source-side heat exchanger which functions as a refrigerant cooler, and operation efficiency can further be improved.

During heating operation, since the temperature of the refrigerant discharged from the compression mechanism is kept low, the heating capacity per unit volume of the refrigerant in the utilization-side heat exchanger is reduced. The heating capacity in the utilization-side heat exchanger is assured and operation efficiency can be improved because the flow rate of the refrigerant discharged from the second-stage compression element is increased.

A refrigeration apparatus according to a seventh aspect of the present invention is the refrigerant apparatus according to the sixth aspect, and further comprises an economizer heat exchanger for carrying out heat exchange between the refrigerant fed from the heat-source-side heat exchanger or the utilization-side heat exchanger to the expansion mechanism, and the refrigerant that flows through the injection pipe.

With this refrigeration apparatus, the economizer heat exchanger can cool the refrigerant fed from the heat-source-side heat exchanger or the utilization-side heat exchanger to the expansion mechanism by using the refrigerant that flows through the injection pipe. The economizer heat exchanger can heat the refrigerant that flows through the injection pipe. Accordingly the operation efficiency of the refrigeration apparatus can further be improved.

The cooling capacity per unit volume of the refrigerant in the utilization-side heat exchanger can be increased during the cooling operation, and the flow rate of the refrigerant discharged from the second-stage compression element can be increased during the heating operation.

A refrigeration apparatus according to an eighth aspect of the present invention is the refrigerant apparatus according to the seventh aspect, wherein the economizer heat exchanger is a heat exchanger having a conduit through which the refrigerant fed from the heat-source-side heat exchanger or the utilization-side heat exchanger to the expansion mechanism, and the refrigerant that flows through the injection pipe flow in opposing directions.

With this refrigeration apparatus, it is possible to reduce the temperature difference between the refrigerant fed to the expansion mechanisms from the heat-source-side heat exchanger or the utilization-side heat exchanger in the economizer heat exchanger and the refrigerant flowing through the injection pipe. Accordingly, heat exchange efficiency in the economizer heat exchanger can be improved.

A refrigeration apparatus according to a ninth aspect of the present invention is the refrigerant apparatus according to the seventh or eighth aspect, wherein the injection pipe is provided so as to branch off the refrigerant fed from the heat-source-side heat exchanger or the utilization-side heat exchanger to the expansion mechanism before the refrigerant fed from the heat-source-side heat exchanger or the utilization-side heat exchanger to the expansion mechanism undergoes heat exchange in the economizer heat exchanger.

With this refrigeration apparatus, the flow rate of the refrigerant fed from the heat-source-side heat exchanger or the utilization-side heat exchanger to the expansion mechanisms can be reduced. It is thereby possible to reduce heat-exchange rate between the refrigerant fed from the heat-source-side heat exchanger or the utilization-side heat exchanger to the expansion mechanisms and the refrigerant that flows through the injection pipe in the economizer heat exchanger. Accordingly, the size of the economizer heat exchanger can be reduced.

A refrigeration apparatus according to a tenth aspect of the present invention is the refrigerant apparatus according to any of the sixth through ninth aspects, wherein the injection pipe is provided so that the refrigerant fed from the heat-source-side heat exchanger or the utilization-side heat exchanger to the expansion mechanism is branched off and guided between the intercooler, and the first high-pressure compression element and/or the second high-pressure compression element.

With this refrigeration apparatus, the refrigerant fed from the heat-source-side heat exchanger or the utilization-side heat exchanger to the compression mechanisms is branched off and directed between the intercooler, the first high-pressure compression element and/or the second high-pressure compression element via the injection pipe. Accordingly, the refrigerant discharged from the first low-pressure compression element or the second low-pressure compression element can be cooled by the intercooler prior to being cooled by the refrigerant introduced between the intercooler and the first high-pressure compression element and/or the second high-pressure compression element via the injection pipe.

Therefore, it is possible to improve efficiency when the refrigerant discharged from the first low-pressure compression element or the second low-pressure compression element and destined for the first high-pressure compression element or the second high-pressure compression element is cooled in a stepwise fashion in the case that the temperature of the refrigerant directed between the intercooler and the first high-pressure compression element and/or the second high-pressure compression element via the injection pipe is lower than the cooling temperature of the intercooler.

A refrigeration apparatus according to an eleventh aspect of the present invention is the refrigerant apparatus according to any of the first through tenth aspects, wherein a single intercooler is provided to the compression mechanism having the first compressor and the second compressor.

With this refrigeration apparatus, since there is only a single intercooler, it is possible to keep costs lower than in the case that multiple intercoolers are provided.

A refrigeration apparatus according to a twelfth aspect of the present invention is the refrigerant apparatus according to any of the first through eleventh aspects, and further comprises a switching mechanism and an intermediate cooling function-switching element or means. The switching mechanism switches between a cooling operation state for circulating the refrigerant through the compression mechanism, the heat-source-side heat exchanger, the expansion mechanism, and the utilization-side heat exchanger in the stated sequence; and a heating operation state for circulating the refrigerant through the compression mechanism, the utilization-side heat exchanger, the expansion mechanism, and the heat-source-side heat exchanger in the stated sequence. The intermediate cooling function-switching element (means) causes the intercooler to function as a cooler when the switching mechanism is in the cooling operation state, and does not allow the intercooler to function as a cooler when the switching mechanism in the heating operation state. As used herein, the phrase "does not allow the intercooler to function as a cooler" does not only include a case in which the intercooler is set in a state in which its function as an intercooler is completely undemonstrated, but also refers a state in which the intercooler is not used in a normal state and is essentially regarded to not be functioning as an intercooler, such as when the feeding of a cooling source to an intercooler is stopped, even when some function as an intercooler is partially demonstrated.

In the refrigeration apparatus, since the temperature of the refrigerant sucked into the compression element of the high-pressure side is reduced even when only an intercooler is provided, the temperature of the refrigerant discharged from the compression mechanism can be finally kept low in comparison with when an intercooler is not provided. Operation efficiency can therefore be improved during cooling operation because loss from heat dissipation can be reduced in the heat-source-side heat exchanger which functions as a refrigerant cooler. However, when an intercooler is not provided, heat that could be used in the utilization-side heat exchanger during heating operation ends up being dissipated from the intercooler to the exterior. Operation efficiency is therefore reduced because the heating capacity in the utilization-side heat exchanger is reduced.

In view of the above, with this refrigeration apparatus, an intermediate cooling function-switching means is provided in addition to an intercooler, and the intermediate cooling function-switching means is used for causing the intercooler to function as a cooler when the switching mechanism is set in the cooling operation state, and is used for not allowing the intercooler to function as a cooler when the switching mechanism is set in the heating operation state. Accordingly, with this refrigeration apparatus, the temperature of the refrigerant discharged from the compression mechanism can be kept low during cooling operation; and during heating operation, heat dissipation to the exterior is suppressed and a reduction in the temperature of the refrigerant discharged from the compression mechanism can be suppressed.

Therefore, with this refrigeration apparatus, loss by heat radiation can be reduced in the heat-source-side heat exchanger which functions as a refrigerant cooler, and operation efficiency can be improved during the cooling operation. Also, a reduction of heating capacity can be suppressed and a reduction in operating efficiency can be prevented during heating operation.

A refrigeration apparatus according to a thirteenth aspect of the present invention is the refrigerant apparatus according to any of the first through twelfth aspects, wherein the refrigerant that operates in the region including critical processes is carbon dioxide.

Effects of the Invention

As described above, the following effects are obtained in accordance with the present invention.

With the first and thirteenth aspects, the degree of freedom for adjusting the refrigerant circulation rate by using multi-stage compression-type compression elements can be increased and the operation efficiency can be improved while keeping the size of the apparatus from increasing in a refrigeration apparatus using a refrigerant that operates in a region including critical processes.

With the second aspect, the intercooler can cool only shared portions, and there is no need to provide a configuration for separately cooling the refrigerant discharged from the first low-pressure compression element and the refrigerant discharged from the second low-pressure compression element.

With the third aspect, the intermediate cooling part can separately cool the refrigeration compressed by the first compressor and the refrigerant compressed by the second compressor.

With the fourth aspect, the refrigerant can be made to flow between the first compressor and the second compressor.

With the fifth aspect, at least one of the following effects can be obtained. The rotating shaft of the first high-pressure compression element and the rotating shaft of the first low-pressure compression element can both be driven by a single drive force, or the rotating shaft of the second high-pressure compression element and the rotating shaft of the second low-pressure compression element can both be driven by a single drive force.

With the sixth aspect, loss by heat radiation can be further reduced in the heat-source-side heat exchanger which functions as a refrigerant cooler, and operation efficiency can be further improved.

With the seventh aspect, the operation efficiency of the refrigeration apparatus can be further improved.

With the eighth aspect, the heat exchange efficiency in the economizer heat exchanger can be improved.

With the ninth aspect, the size of the economizer heat exchanger can be reduced.

With the tenth aspect, it is possible to improve efficiency when the refrigerant discharged from the first low-pressure compression element or the second low-pressure compression element and destined for the first high-pressure compression element or the second high-pressure compression element is cooled in a stepwise fashion in the case that the temperature of the refrigerant directed between the intercooler and the first high-pressure compression element and/or the second high-pressure compression element via the injection pipe is lower than the cooling temperature of the intercooler.

With the eleventh aspect, it is possible to keep costs lower than in the case that multiple intercoolers are provided.

With the twelfth aspect, operation efficiency can be improved during cooling operation because loss from heat dissipation can be reduced in the heat-source-side heat exchanger which functions as a refrigerant cooler. Also, the reduction in heating capacity is curbed during heating operation and the reduction of operation efficiency can be avoided.

DETAILED DESCRIPTION OF EMBODIMENT(S)

Embodiments of the refrigeration apparatus according to the present invention are described hereinbelow with reference to the figures.

(1) Configuration of Air-Conditioning Apparatus

Figure 1:
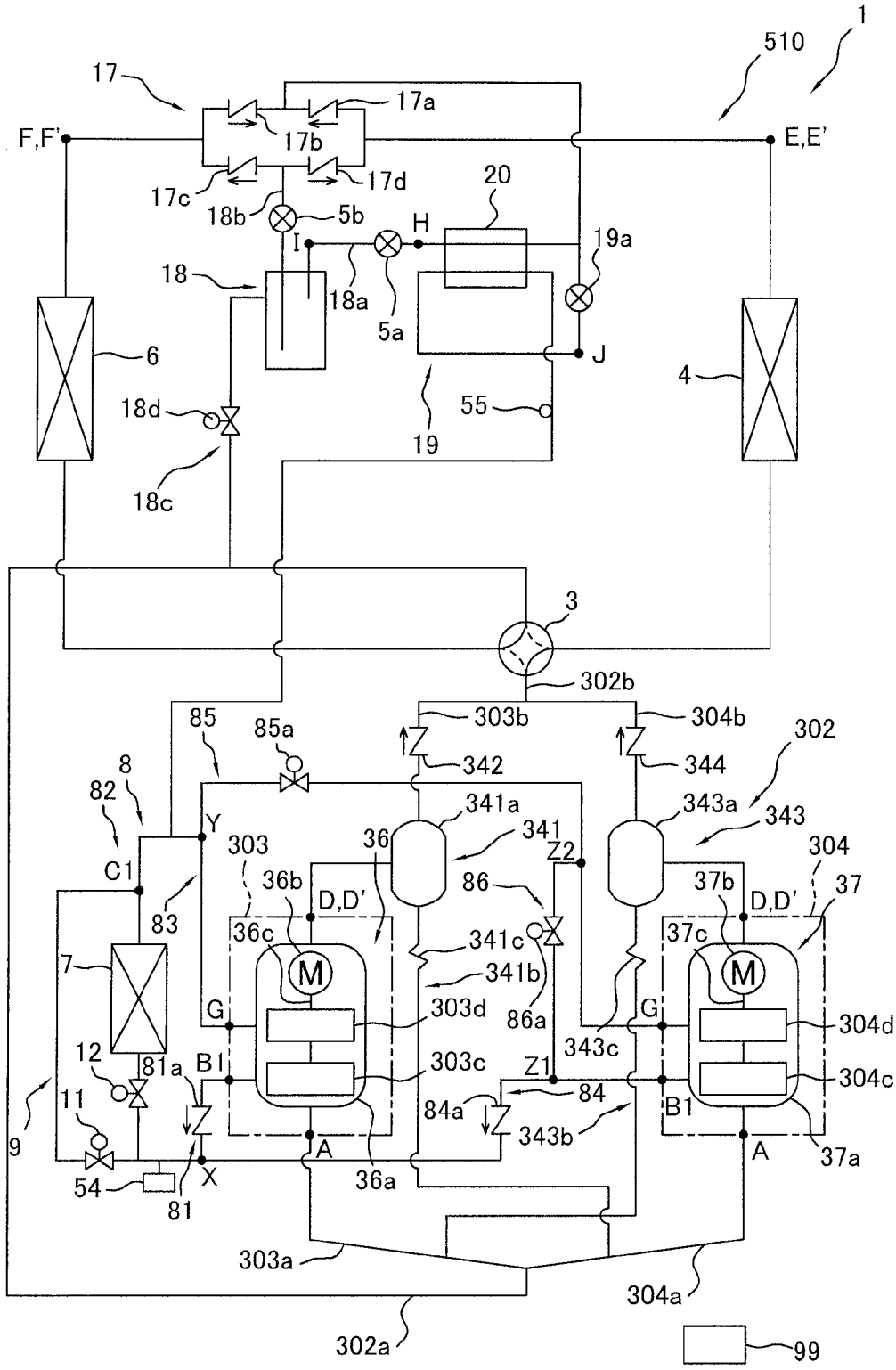
FIG. 1 is a schematic structural diagram of an air-conditioning apparatus as an embodiment of the refrigeration apparatus according to the present invention.

FIG. 1 is a schematic structural diagram of an air-conditioning apparatus 1 as an embodiment of the refrigeration apparatus according to the present invention. The air-conditioning apparatus 1 has a refrigerant circuit 510 configured to be capable of switching between an air-cooling operation and an air-warming operation, and the apparatus performs a two-stage compression refrigeration cycle by using a refrigerant (carbon dioxide in the present embodiment) for operating in a critical range.

The refrigerant circuit 510 of the air-conditioning apparatus 1 has primarily a compression mechanism 302, a switching mechanism 3, a heat-source-side heat exchanger 4, a bridge circuit 17, a receiver 18, a receiver inlet expansion mechanism 5*a*, a receiver outlet expansion mechanism 5*b*, a second stage injection pipe 19, an economizer heat exchanger 20, a utilization-side heat exchanger 6, and an intercooler 7.

<Compression Mechanism>

The compression mechanism 302 is a parallel multistage compression-type compression mechanism in which a plurality of lines (two lines, in the present embodiment) of multistage (two stages, in the present embodiment) compression-type compression mechanisms are connected in parallel. In the present embodiment, the compression mechanism is composed of a two-stage compression-type first compression mechanism 303 having compression elements 303*c*, 303*d*, and a two stage compression-type second compression mechanism 304 having compression elements 304*c*, 304*d*.

In the present embodiment, the first compression mechanism 303 is composed of a compressor 36 for compressing refrigerant in two stages using the two compression elements 303*c*, 303*d*, and is connected to a first intake branch pipe 303*a* that branches off from an intake header pipe 302*a* of the compression mechanism 302, and to a first discharge branch pipe 303*b* that merges with a discharge header pipe 302*b* of the compression mechanism 302. In the present embodiment, the second compression mechanism 304 is composed of a compressor 37 for compressing refrigerant in two stages using the two compression elements 304*c*, 304*d*, and is connected to a second intake branch pipe 304*a* that branches off from the intake header pipe 302*a* of the compression mechanism 302, and to a second discharge branch pipe 304*b* that merges with a discharge header pipe 302*b* of the compression mechanism 302.

The compressor 36 has a sealed structure that accommodates a compressor drive motor 36*b*, a drive shaft 36*c*, and the compression elements 303*c*, 303*d* in a casing 36*a*. The compressor drive motor 36*b* is connected to the drive shaft 36*c*. The drive shaft 36*c* is connected to the two compression elements 303*c*, 303*d*. Specifically, the compressor 36 has a so-called single-shaft two-stage compression structure in which the two compression elements 303*c*, 303*d* are connected to a single drive shaft 36*c*, and the two compression elements 303*c*, 303*d* are rotatably driven by the compressor drive motor 36*b*. The compressor 36 is configured so that refrigerant is sucked from the first intake branch pipe 303*a*, the refrigerant thus sucked in is compressed by the compression element 303*c* and then discharged to a first inlet-side intermediate branch pipe 81 that constitutes the intermediate refrigerant pipe 8, the refrigerant discharged to the first inlet-side intermediate branch pipe 81 is caused to be sucked into the first high-pressure compression element 303*d* by way of an intermediate header pipe 82 and a first outlet-side intermediate branch pipe 83 constituting the intermediate refrigerant pipe 8, and the refrigerant is further compressed and then discharged to the first discharge branch pipe 303*b*.

The compressor 37 has a sealed structure that accommodates a compressor drive motor 37*b*, a drive shaft 37*c*, and the compression elements 304*c*, 304*d* in a casing 37*a*. The compressor drive motor 37*b* is connected to the drive shaft 37*c*. The drive shaft 76*c* is connected to the two compression elements 304*c*, 304*d*. Specifically, the compressor 37 has a so-called single-shaft two-stage compression structure in which the two compression elements 304*c*, 304*d* are connected to the drive shaft 37*c* (single shaft), and the two compression elements 304*c*, 304*d* are rotatably driven by the compressor drive motor 37*b*. The compressor 37 is configured so that refrigerant is sucked from the first intake branch pipe 304*a*, compressed by the compression element 304*c*, and then discharged to a second inlet-side intermediate branch pipe 84 that constitutes the intermediate refrigerant pipe 8; and the refrigerant discharged to the second inlet-side intermediate branch pipe 84 is sucked into the compression element 304*d* by way of the intermediate header pipe 82 and a second outlet-side intermediate branch pipe 85 constituting the intermediate refrigerant pipe 8, and further compressed and discharged to the second discharge branch pipe 304*b*.

In the present embodiment, the intermediate refrigerant pipe 8 is a refrigerant pipe for sucking the refrigerant, discharged from the compression elements 303*c*, 304*c* connected to the first-stage side of the compression elements 303*d*, 304*d*, into the compression elements 303*d*, 304*d* connected to the second-stage side of the compression elements 303*c*, 304*c*, and is mainly composed of the first inlet-side intermediate branch pipe 81 connected to the discharge side of the compression element 303*c* of the first stage side of the first compression mechanism 303; the second inlet-side intermediate branch pipe 84 connected to the discharge side of the compression element 304*c* of the first stage side of the second compression mechanism 304; the intermediate header pipe 82 with which the two inlet-side intermediate branch pipes 81, 84 merge at the merge point X; the first outlet-side intermediate branch pipe 83 branched off from the intermediate header pipe 82 at a branch point Y and connected to the intake side of the compression element 303*d* of the second-stage side of the first compression mechanism 303; and the second outlet-side intermediate branch pipe 85 branched off from the intermediate header pipe 82 and connected to the intake side of the compression element 304*d* of the second-stage side of the second compression mechanism 304.

Specifically, the intercooler 7 is regarded as being disposed between the merge point X and the branch point Y.

The discharge header pipe 302*b* is a refrigerant pipe for feeding refrigerant discharged from the compression mechanism 302 to the switching mechanism 3. A first oil separation mechanism 341 and a first non-return mechanism 342 are provided to the first discharge branch pipe 303*b* connected to the discharge header pipe 302*b*. A second oil separation mechanism 343 and a second non-return mechanism 344 are provided to the second discharge branch pipe 304*b* connected to the discharge header pipe 302*b*.

The first oil separation mechanism 341 is a mechanism whereby refrigeration oil that accompanies the refrigerant discharged from the first compression mechanism 303 is separated from the refrigerant and returned to the intake side of the compression mechanism 302. The first oil separation mechanism 341 mainly has a first oil separator 341*a* for separating from the refrigerant the refrigeration oil that accompanies the refrigerant discharged from the first compression mechanism 303, and a first oil return pipe 341*b* that is connected to the first oil separator 341*a* and that is used for returning the refrigeration oil separated from the refrigerant to the intake side of the compression mechanism 302.

The second oil separation mechanism 343 is a mechanism whereby refrigeration oil that accompanies the refrigerant discharged from the second compression mechanism 304 is separated from the refrigerant and returned to the intake side of the compression mechanism 302. The second oil separation mechanism 343 mainly has a second oil separator 343*a* for separating from the refrigerant the refrigeration oil that accompanies the refrigerant discharged from the second compression mechanism 304, and a second oil return pipe 343*b* that is connected to the second oil separator 343*a* and that is used for returning the refrigeration oil separated from the refrigerant to the intake side of the compression mechanism 302.

In the present embodiment, the first oil return pipe 341*b* is connected to the second intake branch pipe 304*a*, and the second oil return pipe 343*b* is connected to the first intake branch pipe 303*a*. Accordingly, a greater amount of refrigeration oil returns to one of the compression mechanism 303, 304 that has the lesser amount of refrigeration oil even when there is an imbalance between the amount of refrigeration oil that accompanies the refrigerant discharged from the first compression mechanism 303 and the amount of refrigeration oil that accompanies the refrigerant discharged from the second compression mechanism 304, which is due to the imbalance in the amount of refrigeration oil retained in the first compression mechanism 303 and the amount of refrigeration oil retained in the second compression mechanism 304. The imbalance between the amount of refrigeration oil retained in the first compression mechanism 303 and the amount of refrigeration oil retained in the second compression mechanism 304 is therefore resolved.

In the present embodiment, the first discharge branch pipe 303*a* is configured so that the portion between the merging portion with the second oil return pipe 343*b* and the merging portion with the intake header pipe 302*a* slopes downward toward the portion that merges with the intake header pipe 302*a*. The second intake branch pipe 304*a* is configured so that the portion between the merging point with the first oil return pipe 341*b* and the merging point with the intake header pipe 302*a* slopes downward toward the merging point with the intake header pipe 302*a*. Accordingly, when one of the compression mechanisms 303, 304 is stopped (in the present embodiment, the second compression mechanism 304 is stopped because the first compression mechanism 303 is operated with priority), the refrigeration oil returned from the first oil return pipe 341*b*, which corresponds to the operating first compression mechanism 303, to the second intake branch pipe 304*a*, which corresponds to the stopped second compression mechanism 304, is returned to the intake header pipe 302*a*; and it is less likely that oil will be depleted in the operating first compression mechanism 303. The oil return pipes 341*b*, 343*b* are provided with depressurizing mechanisms 341*c*, 343*c* for depressurizing the refrigeration oil that flows through the oil return pipes 341*b*, 343*b*. The non-return mechanisms 342, 344 are mechanisms for allowing refrigerant to flow from the discharge side of the compression mechanisms 303, 304 to the switching mechanism 3, and for cutting off the flow of refrigerant from the switching mechanism 3 to the discharge side of the compression mechanisms 303, 304.

Thus, in the present embodiment, the compression mechanism 302 has a configuration in which the first compression mechanism 303 and the second compression mechanism 304 are connected in parallel. The first compression mechanism 303 has two compression elements 303*c*, 303*d* and is configured so as to use a second-stage-side compression element to sequentially compress the refrigerant discharged from a first-stage-side compression element among the compression elements 303*c*, 303*d*. The second compression mechanism 304 has two compression elements 304*c*, 304*d* and is configured so as to use a second-stage-side compression element to sequentially compress the refrigerant discharged from a first-stage-side compression element among the compression elements 304*c*, 304*d*.

<Switching Mechanism>

The switching mechanism 3 is a mechanism for switching the direction of the flow of refrigerant in the refrigerant circuit 510. During air-cooling operation, the switching mechanism 3 connects the discharge side of the compression mechanism 302 to one end of the heat-source-side heat exchanger 4, and connects the intake side of the compression mechanism 21 to the utilization-side heat exchanger 6 in order to cause the heat-source-side heat exchanger 4 to function as a cooler of the refrigerant compressed by the compression mechanism 302 and to cause the utilization-side heat exchanger 6 to function as a heater of the refrigerant cooled in the heat-source-side heat exchanger 4 (see the solid line of the switching mechanism 3 in FIG. 1; this state of the switching mechanism 3 will be referred hereinbelow as "cooling operation state"). During air-warming operation, the switching mechanism 3 can connect the discharge side of the compression mechanism 302 and the utilization-side heat exchanger 6, and connect the intake side of the compression mechanism 302 and one end of the heat-source-side heat exchanger 4 in order to cause the utilization-side heat exchanger 6 to function as a cooler of the refrigerant compressed by the compression mechanism 302, and to cause the heat-source-side heat exchanger 4 to function as a heater of the refrigerant cooled in the utilization-side heat exchanger 6 (see the broken line of the switching mechanism 3 in FIG. 1; this state of the switching mechanism 3 will be referred hereinbelow as "heating operation state"). In the present embodiment, the switching mechanism 3 is a four-way switching valve connected to the intake side of the compression mechanism 302, the discharge side of the compression mechanism 302, the heat-source-side heat exchanger 4, and the utilization-side heat exchanger 6. The switching mechanism 3 is not limited to a four-way switching valve, and may be configured so as to have a function for switching the direction of the flow of the refrigerant in the same manner as described above by using, e.g., a combination of a plurality of electric valves.

Thus, when viewed only in terms of the compression mechanism 302, the heat-source-side heat exchanger 4, the expansion mechanisms 5*a*, 5*b*, and the utilization-side heat exchanger 6 that constitute the refrigerant circuit 510, the switching mechanism 3 is configured so as to be capable of switching between a cooling operation state for circulating refrigerant in the sequence of the compression mechanism 302, the heat-source-side heat exchanger 4, the expansion mechanisms 5*a*, 5*b*, and the utilization-side heat exchanger 6, and a heating operation state for circulating the refrigerant in the sequence of the compression mechanism 302, the utilization-side heat exchanger 6, the expansion mechanisms 5*a*, 5*b*, and the heat-source-side heat exchanger 4.

<Heat-Source-Side Heat Exchanger>

The heat-source-side heat exchanger 4 is a heat exchanger that functions as a cooler or heater of the refrigerant. One end of the heat-source-side heat exchanger 4 is connected to the switching mechanism 3, and the other end is connected to the receiver inlet expansion mechanism 5*a* via the bridge circuit 17 and the economizer heat exchanger 20. Though not shown in the figures, the heat-source-side heat exchanger 4 is supplied with water or air as a heating source or cooling source for conducting heat exchange with the refrigerant flowing through the heat-source-side heat exchanger 4.

<Bridge Circuit>

The bridge circuit 17 is disposed between the heat-source-side heat exchanger 4 and the utilization-side heat exchanger 6, and is connected to a receiver inlet pipe 18*a* connected to the inlet of the receiver 18 and to a receiver outlet pipe 18*b* connected to the outlet of the receiver 18. The bridge circuit 17 has four non-return valves 17*a*, 17*b*, 17*c*, 17*d* in the present embodiment. The inlet non-return valve 17*a* is a non-return valve that allows only the flow of refrigerant from the heat-source-side heat exchanger 4 to the receiver inlet pipe 18*a*. The inlet non-return valve 17*b* is a non-return valve that allows only the flow of refrigerant from the utilization-side heat exchanger 6 to the receiver inlet pipe 18*a*. In other words, the inlet non-return valves 17*a*, 17*b* have a function for allowing refrigerant to flow from one side of the heat-source-side heat exchanger 4 or the utilization-side heat exchanger 6 to the receiver inlet pipe 18*a*. The outlet non-return valve 17*c* is a non-return valve that allows only the flow of refrigerant from the receiver outlet pipe 18*b* to the utilization-side heat exchanger 6. The outlet non-return valve 17*d* is a non-return valve that allows only the flow of refrigerant from the receiver outlet pipe 18*b* to the heat-source-side heat exchanger 4. In other words, the outlet non-return valves 17*c*, 17*d* have a function for allowing refrigerant to flow from the receiver outlet pipe 18*b* to the other side of the heat-source-side heat exchanger 4 or the utilization-side heat exchanger 6.

<Expansion Mechanisms and Receivers>

The receiver inlet expansion mechanism 5*a* is a mechanism for depressurizing the refrigerant, is provided to the receiver inlet pipe 18*a*, and is an electrically driven expansion valve in the present embodiment. One end of the receiver inlet expansion mechanism 5*a* is connected to the heat-source-side heat exchanger 4 via the economizer heat exchanger 20 and the bridge circuit 17, and the other end is connected to the receiver 18. In the present embodiment, during air-cooling operation, the receiver inlet expansion mechanism 5*a* depressurizes the high-pressure refrigerant cooled in the heat-source-side heat exchanger 4 prior to sending the refrigerant to the utilization-side heat exchanger 6, and during air-warming operation, depressurizes the high-pressure refrigerant cooled in the utilization-side heat exchanger 6 prior to sending the refrigerant to the heat-source-side heat exchanger 4.

The receiver 18 is a container provided for temporarily pooling refrigerant that has been depressurized in the receiver inlet expansion mechanism 5*a*, the inlet of the receiver is connected to the receiver inlet pipe 18*a*, and the outlet of the receiver is connected to the receiver outlet pipe 18*b*. An intake return pipe 18*c* that is capable of removing and returning refrigerant from inside the receiver 18 to the intake pipe 302*a* of the compression mechanism 302 (i.e., the intake side of the first-stage compression element 303*c*, 304*c* of the compression mechanism 302) is provided to the receiver 18. The intake return pipe 18*c* is provided with an intake return on/off valve 18*d*. The intake return on/off valve 18*d* is an electric valve in the present embodiment.

The receiver outlet expansion mechanism 5*b* is a mechanism provided to the receiver outlet pipe 18*b* and used for depressurizing the refrigerant, and is an electrically driven expansion valve in the present embodiment. One end of the receiver outlet expansion mechanism 5*b* is connected to the receiver 18 and the other end is connected to the utilization-side heat exchanger 6 via the bridge circuit 17. In the present embodiment, during air-cooling operation, the receiver outlet expansion mechanism 5*b* further depressurizes the refrigerant depressurized by the receiver inlet expansion mechanism 5*a* until a low pressure is achieved before the refrigerant is sent to the utilization-side heat exchanger 6; and during air-warming operation, the refrigerant depressurized by the receiver inlet expansion mechanism 5*a* is further depressurized until a low pressure is achieved before the refrigerant is sent to the heat-source-side heat exchanger 4.

<Usage-Side Heat Exchanger>

The utilization-side heat exchanger 6 is a heat exchanger that functions as a heater or a cooler of the refrigerant. One end of the utilization-side heat exchanger 6 is connected to the receiver inlet expansion mechanism 5*a* via the bridge circuit 17, and the other end is connected to the switching mechanism 3. Though not shown herein, the utilization-side heat exchanger 6 is supplied with water or air as a heating source or cooling source for conducting heat exchange with the refrigerant flowing through the utilization-side heat exchanger 6.

Thus, when the switching mechanism 3 is brought to the cooling operation state by the bridge circuit 17, the receiver 18, the receiver inlet pipe 18*a*, and the receiver outlet pipe 18*b*, the high-pressure refrigerant cooled in the heat source-side heat exchanger 4 can be fed to the utilization-side heat exchanger 6 through the inlet non-return valve 17*a* of the bridge circuit 17, the receiver inlet expansion mechanism 5*a* of the receiver inlet pipe 18*a*, the receiver 18, the receiver outlet expansion mechanism 5*b* of the receiver outlet pipe 18*b*, and the outlet non-return valve 17*c* of the bridge circuit 17. When the switching mechanism 3 is brought to the heating operation state, the high-pressure refrigerant cooled in the utilization-side heat exchanger 6 can be fed to the heat source-side heat exchanger 4 through the inlet non-return valve 17*b* of the bridge circuit 17, the receiver inlet expansion mechanism 5*a* of the receiver inlet pipe 18*a*, the receiver 18, the receiver outlet expansion mechanism 5*b* of the receiver outlet pipe 18*b*, and the outlet non-return valve 17*d* of the bridge circuit 17.

<Second-Stage Injection Pipe>

The second-stage injection pipe 19 has the function of branching off the refrigerant cooled in the heat source-side heat exchanger 4 or the utilization-side heat exchanger 6 and returning the refrigerant to the second-stage compression elements 303*d*, 304*d* of the compression mechanism 302. In the present embodiment, the second-stage injection pipe 19 is provided so as to branch off the refrigerant flowing through the receiver inlet pipe 18*a* and return the refrigerant to the inlet side of the second-stage compression elements 303*d*, 304*d*. More specifically, the second-stage injection pipe 19 is provided so as to branch off the refrigerant from a position upstream of the receiver inlet expansion mechanism 5*a* of the receiver inlet pipe 18*a* (specifically, between the heat source-side heat exchanger 4 and the receiver inlet expansion mechanism 5*a* when the switching mechanism 3 is in the cooling operation state, and between the utilization-side heat exchanger 6 and the receiver inlet expansion mechanism 5*a* when the switching mechanism 3 is in the heating operation state) and return the refrigerant to a position downstream (i.e., between the merging point X and the branching point Y) of the intercooler 7 of the intermediate refrigerant pipe 8. The second-stage injection pipe 19 is provided with a second-stage injection valve 19*a* whose position can be controlled.

The second-stage injection valve 19*a* is an electric expansion valve in the present embodiment.

<Economizer Heat Exchanger>

The economizer heat exchanger 20 is a heat exchanger for conducting heat exchange between the refrigerant cooled in the heat source-side heat exchanger 4 or the utilization-side heat exchanger 6 and the refrigerant flowing through the second-stage injection pipe 19 (more specifically, the refrigerant that has been depressurized nearly to an intermediate pressure in the second-stage injection valve 19*a*). In the present embodiment, the economizer heat exchanger 20 is provided so as to conduct heat exchange between the refrigerant flowing through a position upstream (specifically, between the heat source-side heat exchanger 4 and the receiver inlet expansion mechanism 5*a* when the switching mechanism 3 is in the cooling operation state, and between the utilization-side heat exchanger 6 and the receiver inlet expansion mechanism 5*a* when the switching mechanism 3 is in the heating operation state) of the receiver inlet expansion mechanism 5*a* of the receiver inlet pipe 18*a* and the refrigerant flowing through the second-stage injection pipe 19, and the economizer heat exchanger 20 has flow channels through which both refrigerants flow so as to oppose each other. In the present embodiment, the economizer heat exchanger 20 is provided upstream of the second-stage injection pipe 19 of the receiver inlet pipe 18*a*. Therefore, the refrigerant cooled in the heat source-side heat exchanger 4 or utilization-side heat exchanger 6 is branched off in the receiver inlet pipe 18*a* into the second-stage injection pipe 19 before undergoing heat exchange in the economizer heat exchanger 20, and heat exchange is then conducted in the economizer heat exchanger 20 with the refrigerant flowing through the second-stage injection pipe 19.

<Intercooler>

In the present embodiment, the intercooler 7 is provided to the intermediate header pipe 82 constituting the intermediate refrigerant pipe 8 and is a heat exchanger for cooling the refrigerant obtained by merging the refrigerant discharged from the first-stage compression element 303*c* of the first compression mechanism 303 and the refrigerant discharged from the first-stage compression element 304*c* of the second compression mechanism 304. Specifically, the intercooler 7 functions as a shared cooler for two compression mechanisms 303, 304. Though not shown in the figures, the intercooler 7 is supplied with water or air as a cooling source for conducting heat exchange with the refrigerant flowing through the intercooler 7. This means that the intercooler 7 is not a component that uses refrigerant that circulates through the refrigerant circuit 510, and can be referred to as a cooler that uses an external heat source.

Accordingly, the circuit configuration is simplified around the compression mechanism 302 when the intercooler 7 is provided to the parallel-multistage-compression-type compression mechanism 302 in which a plurality of multistage-compression-type compression mechanisms 303, 304 are connected in parallel.

The first inlet-side intermediate branch pipe 81 constituting the intermediate refrigerant pipe 8 is provided with an non-return mechanism 81*a* for allowing the flow of refrigerant from the discharge side of the first-stage compression element 303*c* of the first compression mechanism 303 toward the intermediate header pipe 82 and for blocking the flow of refrigerant from the intermediate header pipe 82 toward the discharge side of the first-stage compression element 303*c*, while the second inlet-side intermediate branch pipe 84 constituting the intermediate refrigerant pipe 8 is provided with a non-return mechanism 84*a* for allowing the flow of refrigerant from the discharge side of the first-stage compression element 304*c* of the second compression mechanism 303 toward the intermediate header pipe 82 and for blocking the flow of refrigerant from the intermediate header pipe 82 toward the discharge side of the first-stage compression element 304*c*. In the present embodiment, non-return valves are used as the non-return mechanisms 81*a*, 84*a*.

The second outlet-side intermediate branch pipe 85 is provided with an on/off valve 85*a*. As described above, the flow of refrigerant in the second outlet-side intermediate branch pipe 85 can be blocked by the on/off valve 85*a* when the first compression mechanism 303 is operating and the second compression mechanism 304 is stopped. In the present embodiment, an electric valve is used as the on/off valve 85*a*.

(Startup Bypass Pipe 86)

In the present embodiment, a startup bypass pipe 86 is provided for connecting the discharge side of the first-stage compression element 304*c* of the second compression mechanism 304 and the intake side of the second-stage compression element 304*d*.

Specifically, the startup bypass pipe 86 connects a second low-pressure discharge bypass point Z1 between the non-return mechanism 84*a* and the discharge side of the first-stage compression element 304*c* of the second compression mechanism 304, and the second high-pressure bypass point Z2 between the on/off valve 85*a* and intake side of the second-stage compression element 304*d*.

The startup bypass pipe 86 is provided with an on/off valve 86*a*, and it is possible to carry out operation whereby the second compression mechanism 304 has stopped, the flow of refrigerant through the startup bypass pipe 86 is blocked by the on/off valve 86*a* and the flow of refrigerant through the second outlet-side intermediate branch pipe 85 is blocked by the on/off valve 85*a*, and when the second compression mechanism 304 is started up, a state of allowing refrigerant to flow through the startup bypass pipe 86 can be restored via the on/off valve 86*a*, whereby the refrigerant discharged from the first-stage compression element 304*c* of the second compression mechanism 304 is sucked into the second-stage compression element 304*d* via the startup bypass pipe 86 without merging with the refrigerant discharged from the first-stage compression element 304*c* of the first compression mechanism 303. In the present embodiment, one end of the startup bypass pipe 86 is connected between the on/off valve 85*a* of the second outlet-side intermediate branch pipe 85 and the intake side of the second-stage compression element 304*d* of the second compression mechanism 304, and the other end is connected between the discharge side of the first-stage compression element 304*c* of the second compression mechanism 304 and the non-return mechanism 84*a* of the second inlet-side intermediate branch pipe 84. In the present embodiment, an electric valve is used as the on/off valve 86*a*.

An intercooler bypass pipe 9 (an intermediate cooling function-switching element or means) is connected to the intermediate refrigerant pipe 8 so as to bypass the intercooler 7. This intercooler bypass pipe 9 is a refrigerant pipe for limiting the flow rate of refrigerant flowing through the intercooler 7. The intercooler bypass pipe 9 is provided with an intercooler bypass on/off valve 11. The intercooler bypass on/off valve 11 is an electromagnetic valve in the present embodiment. The intercooler bypass on/off valve 11 essentially is controlled so as to close when the switching mechanism 3 is set for the cooling operation, and to open when the switching mechanism 3 is set for the heating operation. In other words, the intercooler bypass on/off valve 11 is closed when the air-cooling operation is performed and opened when the air-warming operation is performed.

The intermediate refrigerant pipe 8 is provided with a cooler on/off valve 12 in a position leading toward the intercooler 7 from the part connecting with the intercooler bypass pipe 9 (i.e., in the portion leading from the part connecting with the intercooler bypass pipe 9 of the inlet of the intercooler 7 to the connecting part of the outlet of the intercooler 7). The cooler on/off valve 12 is a mechanism for limiting the flow rate of refrigerant flowing through the intercooler 7. The cooler on/off valve 12 is an electromagnetic valve in the present embodiment. Excluding cases in which temporary operations such as the hereinafter-described defrosting operation are performed, the cooler on/off valve 12 essentially is controlled so as to open when the switching mechanism 3 is set for the cooling operation, and to close when the switching mechanism 3 is set for the heating operation. In other words, the cooler on/off valve 12 is controlled so as to open when the air-cooling operation is performed and close when the air-warming operation is performed. In the present embodiment, the cooler on/off valve 12 is provided in a position of the inlet of the intercooler 7, but may also be provided in a position of the outlet of the intercooler 7.

Furthermore, the air-conditioning apparatus 1 is provided with various sensors. Specifically, the intermediate refrigerant pipe 8 or the compression mechanism 302 is provided with an intermediate pressure sensor 54 for detecting the pressure of the refrigerant that flows through the intermediate refrigerant pipe 8. The outlet of the second stage injection pipe 19 side of the economizer heat exchanger 20 is provided with an economizer outlet temperature sensor 55 for detecting the temperature of the refrigerant at the outlet of the second stage injection pipe 19 side of the economizer heat exchanger 20. Though not shown in the figures, the air-conditioning apparatus 1 has a controller 99 for controlling the actions of the compression mechanism 302, the switching mechanism 3, the expansion mechanisms 5*a*, 5*b*, the second-stage injection valve 19*a*, the intercooler bypass on/off valve 11, the cooler on/off valve 12, the on-off valves 85*a*, 86*a*, and the other components constituting the air-conditioning apparatus 1.

(2) Action of the Air-Conditioning Apparatus

Figure 2:
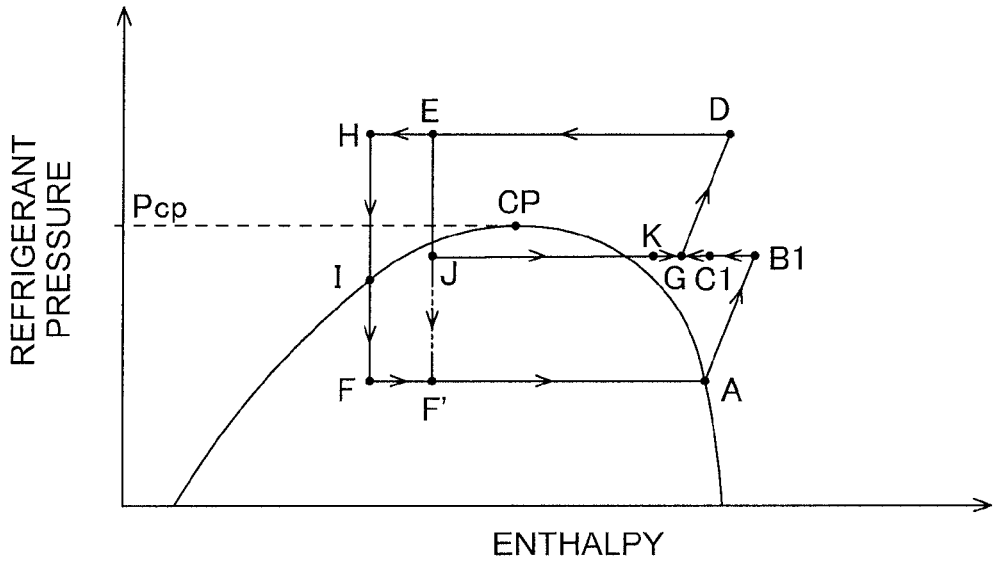
FIG. 2 is a pressure-enthalpy graph representing the refrigeration cycle during the air-cooling operation.
Figure 3:
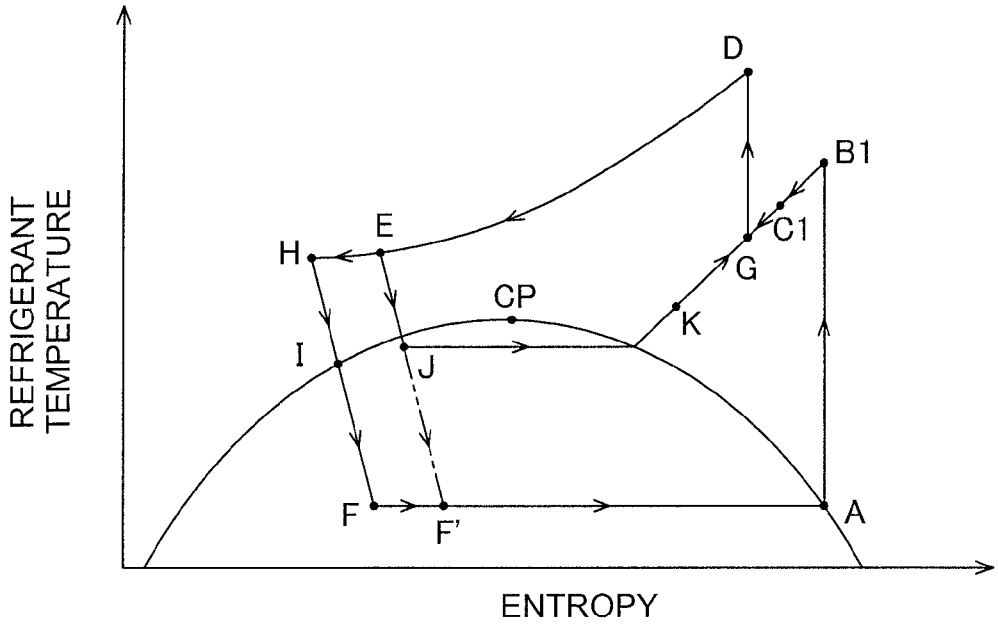
FIG. 3 is a temperature-entropy graph representing the refrigeration cycle during the air-cooling operation.
Figure 4:
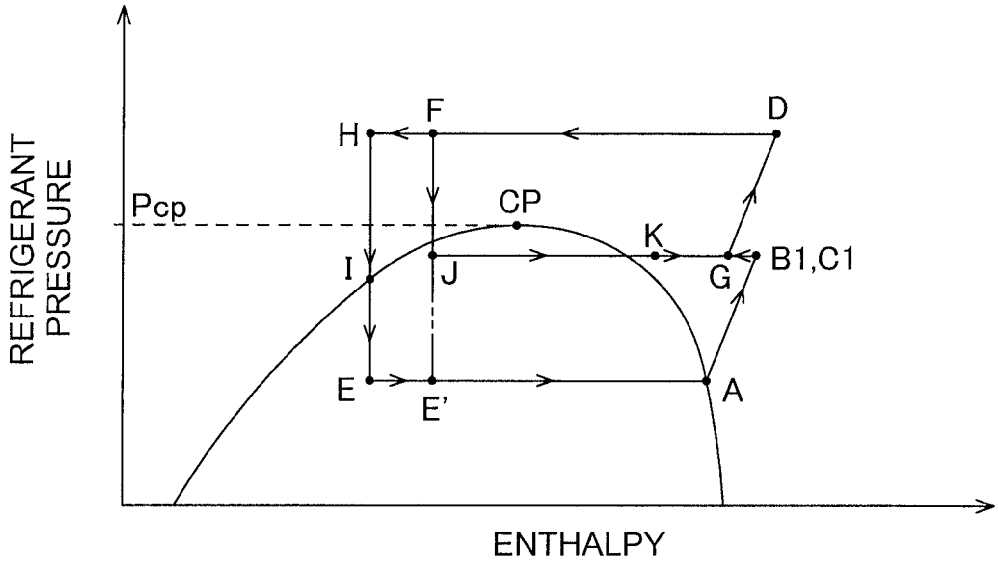
FIG. 4 is a pressure-enthalpy graph representing the refrigeration cycle during the air-warming operation.
Figure 5:
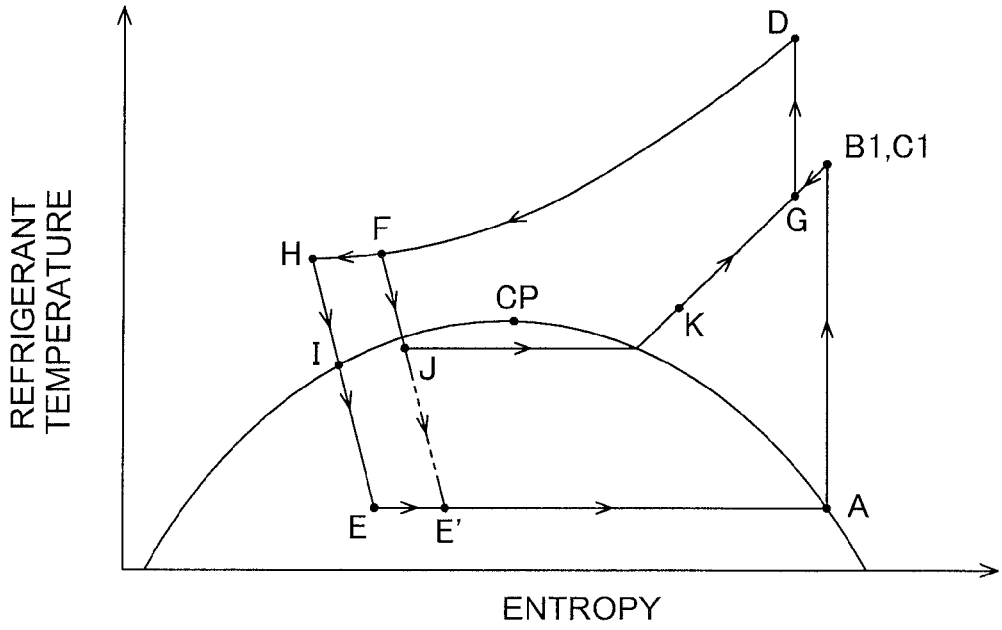
FIG. 5 is a temperature-entropy graph representing the refrigeration cycle during the air-warming operation.

Next, the action of the air-conditioning apparatus 1 of the present embodiment will be described using FIGS. 1 through 5. FIG. 2 is a pressure-enthalpy graph representing the refrigeration cycle during the air-cooling operation, FIG. 3 is a temperature-entropy graph representing the refrigeration cycle during the air-cooling operation, FIG. 4 is a pressure-enthalpy graph representing the refrigeration cycle during the air-warming operation, and FIG. 5 is a temperature-entropy graph representing the refrigeration cycle during the air-warming operation. Operation controls during the following air-cooling operation and air-warming operation are performed by the aforementioned controller (not shown). In the following description, the term "high pressure" means a high pressure in the refrigeration cycle (specifically, the pressure at points D, E, and H in FIGS. 2 and 3, and the pressure at points D, F, and H in FIGS. 4 and 5), the term "low pressure" means a low pressure in the refrigeration cycle (specifically, the pressure at points A, F, and F' in FIGS. 2 and 3, and the pressure at points A, E, and E' in FIGS. 4 and 5), and the term "intermediate pressure" means an intermediate pressure in the refrigeration cycle (specifically, the pressure at points B1, C1, G, J, and K in FIGS. 2 through 5).

<Air-Cooling Operation>

During the air-cooling operation, the switching mechanism 3 is set for the cooling operation as shown by the solid lines in FIG. 1. The opening degrees of the receiver inlet expansion mechanism 5*a* and the receiver outlet expansion mechanism 5*b* are adjusted. Since the switching mechanism 3 is set for the cooling operation, the cooler on/off valve 12 is opened and the intercooler bypass on/off valve 11 of the intercooler bypass pipe 9 is closed, whereby the intercooler 7 is set to function as a cooler. Also, the on/off valve 85*a* is opened and the on/off valve 86*a* is closed. Furthermore, the position of the second-stage injection valve 19*a* is also adjusted. More specifically, in the present embodiment, so-called superheat degree control is performed wherein the position of the second-stage injection valve 19*a* is adjusted so that a target value is achieved in the degree of superheat of the refrigerant at the outlet in the second-stage injection pipe 19 side of the economizer heat exchanger 20. In the present embodiment, the degree of superheat of the refrigerant at the outlet in the second-stage injection pipe 19 side of the economizer heat exchanger 20 is obtained by converting the intermediate pressure detected by the intermediate pressure sensor 54 to a saturation temperature and subtracting this refrigerant saturation temperature value from the refrigerant temperature detected by the economizer outlet temperature sensor 55. Though not used in the present embodiment, another possible option is to provide a temperature sensor to the inlet in the second-stage injection pipe 19 side of the economizer heat exchanger 20, and to obtain the degree of superheat of the refrigerant at the outlet in the second-stage injection pipe 19 side of the economizer heat exchanger 20 by subtracting the refrigerant temperature detected by this temperature sensor from the refrigerant temperature detected by the economizer outlet temperature sensor 55.

In this state of the refrigerant circuit 510, low-pressure refrigerant (refer to point A in FIGS. 1 to 3) is sucked into the compression mechanisms 303, 304 of the compression mechanism 302 through the inlet pipe 302*a*, and after the refrigerant is first compressed by the compression elements 303*c*, 304*c* to an intermediate pressure, the refrigerant is discharged to the intermediate refrigerant pipe 8 (refer to point B1 in FIGS. 1 to 3). This intermediate-pressure refrigerant discharged from the first-stage compression elements 303*c*, 304*c* is cooled by heat exchange with air or water as a cooling source (refer to point C1 in FIGS. 1 to 3). The refrigerant cooled in the intercooler 7 is further cooled (refer to point G in FIGS. 1 to 3) by merging with refrigerant being returned from the second-stage injection pipe 19 to the second-stage-side compression elements 303*d*, 304*d* (refer to point K in FIGS. 1 to 3). Next, having merged with the refrigerant returned from the second-stage injection pipe 19, the intermediate-pressure refrigerant is sucked into and further compressed in the compression elements 303*d*, 304*d* connected to the second-stage side of the compression elements 303*c*, 304*c*; and then discharged from the compression mechanisms 303, 304 to the outlet pipe 302*b* (refer to point D in FIGS. 1 to 3) via the discharge branch pipes 303*a*, 304*a*, the oil separators 341*a*, 343*b*, and non-return mechanisms 342, 344. The high-pressure refrigerant discharged from the compression mechanism 302 is compressed by the two-stage compression action of the compression elements 303*c*, 303*d* of the first compression mechanism 303 and the compression elements 304*c*, 304*d* of the second compression mechanism 304 to a pressure exceeding a critical pressure (i.e., the critical pressure Pcp at the critical point CP shown in FIG. 2). The high-pressure refrigerant discharged from the compression mechanism 302 is fed via the switching mechanism 3 to the heat-source-side heat exchanger 4 functioning as a refrigerant cooler, and the refrigerant is cooled by heat exchange with air or water as a cooling source (refer to point E in FIGS. 1 to 3). The high-pressure refrigerant cooled in the heat-source-side heat exchanger 4 flows through the inlet non-return valve 17*a* of the bridge circuit 17 into the receiver inlet pipe 18*a*, and some of the refrigerant is branched off into the second-stage injection pipe 19. The refrigerant flowing through the second-stage injection pipe 19 is depressurized to a nearly intermediate pressure in the second-stage injection valve 19*a* and is then fed to the economizer heat exchanger 20 (refer to point J in FIGS. 1 to 3). The refrigerant flowing through the receiver inlet pipe 18*a* after being branched off into the second-stage injection pipe 19 then flows into the economizer heat exchanger 20, where it is cooled by heat exchange with the refrigerant flowing through the second-stage injection pipe 19 (refer to point H in FIGS. 1 to 3). The refrigerant flowing through the second-stage injection pipe 19 is heated by heat exchange with the refrigerant flowing through the receiver inlet pipe 18*a* (refer to point K in FIGS. 1 to 3), and this refrigerant is merged with the refrigerant cooled in the intercooler 7 as described above. The high-pressure refrigerant cooled in the economizer heat exchanger 20 is depressurized to a nearly saturated pressure by the receiver inlet expansion mechanism 5*a* and is temporarily retained in the receiver 18 (refer to point I in FIGS. 1 to 3). The refrigerant retained in the receiver 18 is fed to the receiver outlet pipe 18*b*, depressurized by the receiver outlet expansion mechanism 5*b* to become a low-pressure gas-liquid two-phase refrigerant, and then fed through the outlet non-return valve 17*c* of the bridge circuit 17 to the utilization-side heat exchanger 6 functioning as a refrigerant heater (refer to point F in FIGS. 1 to 3). The low-pressure gas-liquid two-phase refrigerant fed to the utilization-side heat exchanger 6 is heated by heat exchange with water or air as a heating source, and the refrigerant is evaporated as a result (refer to point A in FIGS. 1 to 3). The low-pressure refrigerant heated in the utilization-side heat exchanger 6 is once again sucked into the compression mechanism 302 via the switching mechanism 3. In this manner is the air-cooling operation performed.

Thus, in the air-conditioning apparatus 1, the second compression mechanism 304 is furthermore provided in addition to the first compression mechanism 303. The controller 99 of the air-conditioning apparatus 1 is capable of carrying out control for simultaneously setting the first compression mechanism 303 and the second compression mechanism 304 in a drive state. The amount of circulating refrigerant in the air-conditioning apparatus 1 can thereby be increased in comparison with the first compression mechanism 303 alone. Accordingly, the refrigerating capability can be improved. The drive states of the first compression mechanism 303 and the second compression mechanism 304 are adjusted by the controller 99, whereby the range of the degree of freedom for adjusting the flow rate of refrigerant is increased from a state in which both compression mechanisms are stopped at a flow rate of 0 to a flow rate MAX when operating at maximum output.

In the air-conditioning apparatus 1, the intercooler 7 is provided to the intermediate refrigerant pipe 8 for sucking refrigerant discharged from the compression elements 303*c*, 304*c* into the compression elements 303*d*, 304*d*, and in the cooling operation in which the switching mechanism 3 has been set in the cooling operation state, the cooler on/off valve 12 is opened and the intercooler bypass on/off valve 11 of the intercooler bypass pipe 9 is closed, whereby the intercooler 7 is set in a state for function as a cooler. Therefore, the refrigerant sucked into the compression element 2*d* on the second-stage side of the compression element 2*c* decreases in temperature (refer to points B1 and C1 in FIG. 3) and the refrigerant discharged from the compression element 2*d* decreases in temperature in comparison with cases in which no intercooler 7 is provided. Accordingly, in the heat source-side heat exchanger 4 functioning as a cooler of high-pressure refrigerant in this air-conditioning apparatus 1, operating efficiency can be improved over cases in which no intercooler 7 is provided, because the temperature difference between the refrigerant and water or air as the cooling source can be reduced, and heat radiation loss can be reduced.

In this case, a second compression mechanism 304 is furthermore provided in addition to the first compression mechanism 303 in order to increase the flow rate and to increase degree of freedom for adjusting the flow rate, and it is therefore desirable to avoid increasing the size of the apparatus. As a countermeasure to this, in the air-conditioning apparatus 1 of the present embodiment, only one intercooler 7 for increasing capacity is provided and is shared by the compression mechanisms 303, 304. This makes it possible to save space.

Moreover, in the configuration of the present embodiment, since the second-stage injection pipe 19 is provided so as to branch off the refrigerant fed from the heat source-side heat exchanger 4 to the expansion mechanisms 5*a*, 5*b* and return the refrigerant to the second-stage compression elements 303*d*, 340*d*, the temperature of refrigerant sucked into the second-stage compression elements 303*d*, 304*d* can be kept even lower (refer to points C1 and G in FIG. 3) without performing heat radiation to the exterior, such as is done with the intercooler 7. The temperature of refrigerant discharged from the compression mechanism 302 is thereby kept even lower, and operating efficiency can be further improved because heat radiation loss can be further reduced in comparison with cases in which no second-stage injection pipe 19 is provided.

In the configuration of the present embodiment, since an economizer heat exchanger 20 is also provided for conducting heat exchange between the refrigerant fed from the heat source-side heat exchanger 4 to the expansion mechanisms 5*a*, 5*b* and the refrigerant flowing through the second-stage injection pipe 19, the refrigerant fed from the heat source-side heat exchanger 4 to the expansion mechanisms 5*a*, 5*b* can be cooled by the refrigerant flowing through the second-stage injection pipe 19 (refer to points E and H in FIGS. 2 and 3), and the cooling capacity per unit flowing volume of refrigerant in the utilization-side heat exchanger 6 can be increased in comparison with cases in which the intercooler 7, the second-stage injection pipe 19 and economizer heat exchanger 20 are not provided.

In addition to increasing the flow rate of refrigerant by driving both the compression mechanism 303 and the second compression mechanism 304, it is also possible to obtain an effect in which the refrigerating capacity is synergistically increased because the density of the refrigerant is increased by cooling the discharge refrigerant and the weight of the refrigerant per unit volume is increased.

<Air-Warming Operation>

During the air-warming operation, the switching mechanism 3 is brought to the heating operation state shown by the dashed lines in FIG. 1. The opening degrees of the receiver inlet expansion mechanism 5*a* and receiver outlet expansion mechanism 5*b* are adjusted. Since the switching mechanism 3 is in the heating operation state, the cooler on/off valve 12 is closed and the intercooler bypass on/off valve 11 of the intercooler bypass pipe 9 is opened, thereby putting the intercooler 7 in a state of not functioning as a cooler. Also, a state is obtained in which the on/off valve 85*a* is open and the on/off valve 86*a* is closed. Furthermore, the opening degree of the second-stage injection valve 19*a* is also adjusted by the same superheat degree control as in the air-cooling operation.

With the refrigerant circuit 510 is in this state, low-pressure refrigerant (refer to point A in FIGS. 1, 4, and 5) is sucked into the compression mechanisms 303, 304 of the compression mechanism 302 through the intake header pipe 302*a*, and after the refrigerant is first compressed by the compression elements 303*c*, 304*c* to an intermediate pressure, the refrigerant is discharged to the intermediate refrigerant pipe 8 (refer to point B1 in FIGS. 1, 4, and 5). Unlike the air-cooling operation, this intermediate-pressure refrigerant discharged from the first-stage compression element 2*c* passes through the intercooler bypass pipe 9 (refer to point C1 in FIGS. 1, 4, and 5) without passing through the intercooler 7 (i.e. without being cooled), and the refrigerant is cooled (refer to point G in FIGS. 1, 4, and 5) by merging with refrigerant being returned from the second-stage injection pipe 19 to the second-stage compression elements 303*d*, 304*d* (refer to point K in FIGS. 1, 4, and 5). Next, having merged with the refrigerant returning from the second-stage injection pipe 19, the intermediate-pressure refrigerant is sucked into and further compressed in the compression elements 303*d*, 304*d* connected to the second-stage side of the compression elements 303*c*, 304*c*, and discharged from the compression mechanisms 303, 304 to the discharge header pipe 302*b* (refer to point D in FIGS. 1, 4, and 5) via the discharge branch pipes 303*a*, 304*a*, the oil separators 341*a*, 343*b*, and the non-return mechanisms 342, 344. The high-pressure refrigerant discharged from the compression mechanism 302 is compressed by the two-stage compression action of the compression elements 303*c*, 303*d* of the first compression mechanism 303 and the compression elements 304*c*, 304*d* of the second compression mechanism 304 to a pressure exceeding a critical pressure (i.e., the critical pressure Pep at the critical point CP shown in FIG. 4), similar to the air-cooling operation. The high-pressure refrigerant discharged from the compression mechanism 2 is fed via the switching mechanism 3 to the utilization-side heat exchanger 6 functioning as a refrigerant cooler, and the refrigerant is cooled by heat exchange with water or air as a cooling source (refer to point F in FIGS. 1, 4, and 5). The high-pressure refrigerant cooled in the utilization-side heat exchanger 6 flows through the inlet non-return valve 17*b* of the bridge circuit 17 into the receiver inlet pipe 18*a*, and some of the refrigerant is branched off into the second-stage injection pipe 19. The refrigerant flowing through the second-stage injection pipe 19 is depressurized to a nearly intermediate pressure in the second-stage injection valve 19*a*, and is then fed to the economizer heat exchanger 20 (refer to point J in FIGS. 1, 4, and 5). The refrigerant flowing through the receiver inlet pipe 18*a* after being branched off into the second-stage injection pipe 19 then flows into the economizer heat exchanger 20 and is cooled by heat exchange with the refrigerant flowing through the second-stage injection pipe 19 (refer to point H in FIGS. 1, 4, and 5). The refrigerant flowing through the second-stage injection pipe 19 is heated by heat exchange with the refrigerant flowing through the receiver inlet pipe 18*a* (refer to point K in FIGS. 1, 4, and 5), and merges with intermediate-pressure refrigerant discharged from the first-stage compression element 2*c* as described above. The high-pressure refrigerant cooled in the economizer heat exchanger 20 is depressurized to a nearly saturated pressure by the receiver inlet expansion mechanism 5*a* and is temporarily retained in the receiver 18 (refer to point I in FIGS. 1, 4, and 5). The refrigerant retained in the receiver 18 is fed to the receiver outlet pipe 18*b* and is depressurized by the receiver outlet expansion mechanism 5*b* to become a low-pressure gas-liquid two-phase refrigerant, and is then fed through the outlet non-return valve 17*d* of the bridge circuit 17 to the heat source-side heat exchanger 4 functioning as a refrigerant heater (refer to point E in FIGS. 1, 4, and 5). The low-pressure gas-liquid two-phase refrigerant fed to the heat source-side heat exchanger 4 is heated by heat exchange with air or water as a heating source, and is evaporated as a result (refer to point A in FIGS. 1, 4, and 5). The low-pressure refrigerant heated in the heat source-side heat exchanger 4 is once again sucked into the compression mechanism 302 via the switching mechanism 3. In this manner the air-warming operation is performed.

Thus, in the air-conditioning apparatus 1, the intercooler 7 is provided to the intermediate refrigerant pipe 8 for letting refrigerant discharged from the compression elements 303*c*, 304*c* sucked into the compression elements 303*d*, 304*d*, and during the air-warming operation in which the switching mechanism 3 is set to the heating operation state, the cooler on/off valve 12 is closed and the intercooler bypass on/off valve 11 of the intercooler bypass pipe 9 is opened, thereby putting the intercooler 7 into a state of not functioning as a cooler. Therefore, the temperature decrease is suppressed in the refrigerant discharged from the compression mechanism 2, in comparison with cases in which only the intercooler 7 is provided or cases in which the intercooler 7 is made to function as a cooler similar to the air-cooling operation described. Therefore, in the air-conditioning apparatus 1, heat radiation to the exterior can be suppressed, temperature decreases can be suppressed in the refrigerant supplied to the utilization-side heat exchanger 6 functioning as a refrigerant cooler, loss of heating performance can be reduced, and loss of operating efficiency can be prevented, in comparison with cases in which only the intercooler 7 is provided or cases in which the intercooler 7 is made to function as a cooler similar to the air-cooling operation described above.

Moreover, in the configuration of the present embodiment, since the second-stage injection pipe 19 is provided so as to branch off the refrigerant fed from the utilization-side heat exchanger 6 to the expansion mechanisms 5*a*, 5*b* and return the refrigerant to the second-stage compression elements 303*d*, 304*d*, the temperature of the refrigerant discharged from the compression mechanism 302 is lower, and the heating capacity per unit flowing volume of refrigerant in the utilization-side heat exchanger 6 thereby decreases, but since the flowing rate volume of refrigerant discharged from the second-stage compression elements 303*d*, 304*d* increases, the heating capacity in the utilization-side heat exchanger 6 is preserved, and operating efficiency can be improved.

In the configuration of the present embodiment, since the economizer heat exchanger 20 is further provided for conducting heat exchange between the refrigerant fed from the utilization-side heat exchanger 6 to the expansion mechanisms 5*a*, 5*b* and the refrigerant flowing through the second-stage injection pipe 19, the refrigerant flowing through the second-stage injection pipe 19 can be heated by the refrigerant fed from the utilization-side heat exchanger 6 to the expansion mechanisms 5*a*, 5*b* (refer to points J and K in FIGS. 4 and 5), and the flowing rate volume of refrigerant discharged from the second-stage compression element 2*d* can be increased in comparison with cases in which the second-stage injection pipe 19 and economizer heat exchanger 20 are not provided.

Advantages of both the air-cooling operation and the air-warming operation in the configuration of the present modification are that the economizer heat exchanger 20 is a heat exchanger which has flow channels through which refrigerant fed from the heat source-side heat exchanger 4 or utilization-side heat exchanger 6 to the expansion mechanisms 5*a*, 5*b* and refrigerant flowing through the second-stage injection pipe 19 both flow so as to oppose each other; therefore, it is possible to reduce the temperature difference between the refrigerant fed to the expansion mechanisms 5*a*, 5*b* from the heat source-side heat exchanger 4 or the utilization-side heat exchanger 6 in the economizer heat exchanger 20 and the refrigerant flowing through the second-stage injection pipe 19, and high heat exchange efficiency can be achieved. In the configuration of the present modification, since the second-stage injection pipe 19 is provided so as to branch off the refrigerant fed to the expansion mechanisms 5*a*, 5*b* from the heat source-side heat exchanger 4 or the utilization-side heat exchanger 6 before the refrigerant fed to the expansion mechanisms 5*a*, 5*b* from the heat source-side heat exchanger 4 or the utilization-side heat exchanger 6 undergoes heat exchange in the economizer heat exchanger 20, it is possible to reduce the quantity of the refrigerant fed from the heat source-side heat exchanger 4 or utilization-side heat exchanger 6 to the expansion mechanisms 5*a*, 5*b* and subjected to heat exchange with the refrigerant flowing through the second-stage injection pipe 19 in the economizer heat exchanger 20, the flowing rate volume of heat exchanged in the economizer heat exchanger 20 can be reduced, and the size of the economizer heat exchanger 20 can be reduced.

<Startup of the Compression Mechanism>

Next, the operation of the compression mechanism 302 during startup when air-cooling operation or air-warming operation such as that described above will be described. In this case, the air-conditioning apparatus 1 of the present embodiment is configured so that the first compression mechanism 303 is operated with higher priority than the second compression mechanism 304.

Specifically, during startup of the compression mechanism 302, the first compression mechanism 303 is first started up and the second compression mechanism 304 is in a stopped state. In order to further add capacity, the second compression mechanism 304 is subsequently started up to achieve a state in which the first compression mechanism 303 and the second compression mechanism 304 operate simultaneously.

First, when the first compression mechanism 303 is started up, the on/off valve 85*a* and the on/off valve 86*a* are set in a closed state (i.e., a state in which the refrigerant does not flow through the second outlet-side intermediate branch pipe 85 and the startup bypass pipe 86). When the first compression mechanism 303 is stared up, the low-pressure refrigerant is sucked into the compression element 303*c* of the first compression mechanism 303 through the intake header pipe 302*a* and the first intake branch pipe 304*a*, then compressed to intermediate pressure by the first-stage compression element 303*c*, and thereafter discharged to the first inlet-side intermediate branch pipe 81. The intermediate-pressure refrigerant discharged to the first inlet-side intermediate branch pipe 81 is fed to the intermediate header pipe 82 through the non-return mechanism 81*a*. After having passed through the intercooler 7 during the air-cooling operation, or after having passed through the intercooler bypass pipe 9 during air-warming operation, the refrigerant furthermore merges with the refrigerant returning from the second stage injection pipe 19. The refrigerant thus merged is fed to the first outlet-side intermediate branch pipe 83. The intermediate-pressure refrigerant fed to the first outlet-side intermediate branch pipe 83 is sucked into and further compressed by the first second-stage compression element 303*d* connected to the second-stage side of the compression element 303*c*. The refrigerant further compressed by the compression element 303*d* is discharged from the first compression mechanism 303 to the discharge header pipe 302*b* through the discharge branch pipe 303*a*, the first oil separator 341*a*, and the non-return mechanism 342.

(Function of the Second Non-Return Mechanism 84*a*)

In such a state in which a second non-return mechanism 84*a* is not provided and only the first compression mechanism 303 is operating (i.e., a state in which the second compression mechanism 304 is stopped), the refrigerant discharged from the first-stage compression element 303*c* of the operating first compression mechanism 303 passes through the intermediate refrigerant pipe 8 and reaches the discharge side of the first-stage compression element 304*c* of the stopped second compression mechanism 304. At this point, the refrigerant discharged from the first-stage compression element 303*c* of the operating first compression mechanism 303 is liable to escape to the intake side of the compression mechanism 302 through the interior of the first-stage compression element 304*c* of the stopped second compression mechanism 304. A phenomenon occurs in which the refrigeration oil of the stopped second compression mechanism 304 flows out because the refrigerant that escapes to the intake side of the compression mechanism 302 accompanies the refrigeration oil, and the refrigeration oil is likely be deficient when the stopped second compression mechanism 304 is started up.

However, with the air-conditioning apparatus 1 of the present embodiment, since the second non-return mechanism 84*a* is provided, the refrigerant discharged from the first-stage compression element 303*c* of the first compression mechanism 303 does not reach the discharge side of the first-stage compression element 304*c* of the stopped second compression mechanism 304 through the intermediate refrigerant pipe 8. Accordingly, the refrigerant discharged from the first-stage compression element 303*c* of the operating first compression mechanism 303 does not escape to the intake side of the compression mechanism 302 through the interior of the first-stage compression element 304*c* of the stopped second compression mechanism 304 and refrigeration oil of the stopped second compression mechanism 304 does not flow out. It is therefore possible to prevent in advance a situation in which the refrigeration oil is deficient when the stopped second compression mechanism 304 is started up.

In the case that the first compression mechanism 303 is used as the compression mechanism that operates with priority as in the present embodiment, it is possible to omit the non-return mechanism 81*a* and provide only the non-return mechanism 84*a* that corresponds to the second compression mechanism 304.

(Function of the On/Off Valve 85*a*)

In such a state in which an on/off valve 85*a* is not provided to the second outlet-side intermediate branch pipe 85 that corresponds to the stopped second compression mechanism 304 and only the first compression mechanism 303 is operating (i.e., a state in which the second compression mechanism 304 is stopped), the refrigerant discharged from the first-stage compression element 303*c* that corresponds to the operating first compression mechanism 303 passes through the second outlet-side intermediate branch pipe 85 of the intermediate refrigerant pipe 8 and reaches the intake side of the second-stage compression element 304*d* of the stopped second compression mechanism 304. Because the intermediate refrigerant pipe 8 is provided so as to be shared by the compression mechanisms 303, 304. The refrigerant discharged from the first-stage compression element 303*c* of the operating first compression mechanism 303 is therefore liable to escape to the discharge side of the compression mechanism 302 through the interior of the second-stage compression element 304*d* of the stopped second compression mechanism 304. In this case, the refrigeration oil flows out because the refrigerant that escapes to the discharge side of the compression mechanism 302 is accompanied by the refrigeration oil of the stopped second compression mechanism 304, and a deficiency of the refrigeration oil is liable to occur when the stopped second compression mechanism 304 is started up.

However, in the present embodiment, the refrigerant discharged from the first-stage compression element 303*c* that corresponds to the operating first compression mechanism 303 does not reach the intake side of the second-stage compression element 304*d* of the stopped second compression mechanism 304 through the second outlet-side intermediate branch pipe 85 of the intermediate refrigerant pipe 8. It is therefore possible to prevent in advance a situation in which the refrigerant discharged from the first-stage compression element 303*c* of the operating first compression mechanism 303 escapes to the discharge side of the compression mechanism 302 through the interior of the second-stage compression element 304*d* of the stopped second compression mechanism 304, the refrigeration oil of the stopped second compression mechanism 304 flows out, and the refrigeration oil is deficient when the stopped second compression mechanism 304 is started up.

(Function for Reducing Additional Startup of the Later-Starting Compressor)

Next, when the second compression mechanism 304 is started up from a state in which the first compression mechanism 303 has been started up, the on/off valve 85*a* of the second outlet-side intermediate branch pipe 85 is left closed and the on/off valve 86*a* of the startup bypass pipe 86 is opened to set a state in which the refrigerant can flow into the startup bypass pipe 86. At this point, the refrigerant discharged from the first-stage compression element 304*c* of the second compression mechanism 304 does not merge with the refrigerant discharged from the first-stage compression element 304*c* of the first compression mechanism 303, but rather is sucked into the second-stage compression element 304*d* through the startup bypass pipe 86. Alternatively, most of the refrigerant discharged from the first-stage compression element 304*c* of the second compression mechanism 304 does not merge with the refrigerant discharged from the first-stage compression element 304*c* of the first compression mechanism 303, but instead the refrigerant flow sucked into the second-stage compression element 304*d* through the startup bypass pipe 86 becomes the main flow.

It shall be assumed that the on/off valve 85*a* of the second outlet-side intermediate branch pipe 85 is set in the open state with the on/off valve 86*a* of the startup bypass pipe 86 in a closed state. In such a case, the pressure of the discharge side of the first-stage compression element 303*c* of the second compression mechanism 304 and the pressure of the intake side of the second-stage compression element 303*d* is higher than the pressure of the intake side of the first-stage compression element 303*c* and the discharge side of the second-stage compression element 303*d* due to the fact that the intermediate refrigerant pipe 8 is provided in a shared configuration to the compression mechanisms 303, 304. In this state, the second compression mechanism 304 is started up, the load during startup is heavy, or stable startup of the second compression mechanism 304 is otherwise difficult.

However, in the present embodiment, the on/off valve 85*a* of the second outlet-side intermediate branch pipe 85 is left closed and the on/off valve 86*a* of the startup bypass pipe 86 is opened, and the second compression mechanism 304 is started up. Therefore, it is possible to rapidly resolve a situation in which the pressure of the discharge side of the first-stage compression element 303*c* of the second compression mechanism 304 and the pressure of the intake side of the second-stage compression element 303*d* is higher than the pressure of the intake side of the first-stage compression element 303*c* and the pressure of the discharge side of the second-stage compression element 303*d*. Therefore, the compression mechanism 302 reaches a stable operating state (e.g., after the controller 99 has determined that a predetermined length of time has elapsed from the startup of the second compression mechanism 304; a state in which the controller 99 has ascertained that the intake pressure, the discharge pressure, and the intermediate pressure of the compression element 302 have stabilized at predetermined pressures; and the like). In the case that compression mechanism 302 has been detected to be in a stable state of operation, the flow of refrigerant inside the startup bypass pipe 86 is blocked by closing the on/off valve 86*a*, and the on/off valve 85*a* is opened to suck the flow of refrigerant inside the second outlet-side intermediate branch pipe 85 into the second-stage compression element 304*d* of the second compression mechanism 304. Thus, a transition is made from a state in which only the first compression mechanism 303 is operating to ordinary air-cooling operation and air-warming operation in which the first compression mechanism 303 and the second compression mechanism 304 are both operated.

Thus, in the present embodiment, there are cases, as described above, in which the second compression mechanism 304 is difficult to start up while the first compression mechanism 303 is operating, but the second compression mechanism 304 can be reliably started up by the operation of the on/off valves 85*a*, 86*a* such as described above.

Here, when the compression mechanism 302 has been detected to be operating in a stable state, the controller 99 can carry out one of the following two types of control.

The first type of control is an on/off control in which the controller 99 simultaneously carries out an operation for closing the on/off valve 86*a* of the startup bypass pipe 86 and an operation for opening the on/off valve 85*a* of the second outlet-side intermediate branch pipe 85, in the case that the controller 99 has detected that the compression mechanism 302 is in a stable operating state.

The second type of control is an on/off control in which the controller 99 carries out operation for closing the on/off valve 86*a* of the startup bypass pipe 86 after starting (or after the opening operation has ended) the operation for opening the on/off valve 85*a* of the second outlet-side intermediate branch pipe 85, in the case that the controller 99 has detected that the compression mechanism 302 is in a stable state of operation.

In this case, the controller 99 is controlled so that the operation for closing the on/off valve 86*a* of the startup bypass pipe 86 is not carried out prior to the operation for opening the on/off valve 85*a* of the second outlet-side intermediate branch pipe 85. This is due to the fact that in the case that the first-stage compression element 303*c* of the first compression mechanism 303 is driven and an attempt is made to drive the second-stage compression element 304*d* of the stopped second compression mechanism 304, it is difficult to start up the second-stage compression element 304*d* of the second compression mechanism 304 because the space of the intake side of the second-stage compression element 304*d* of the second compression mechanism 304 is a closed space when the on/off valve 85*a* of the second outlet-side intermediate branch pipe 85 and the on/off valve 86*a* of the startup bypass pipe 86 are both in a closed state during startup of the second-stage compression element 304*d*.

(3) Modification 1

The refrigerant circuit 510 (see FIG. 1) in the embodiment described above has a configuration in which a single utilization-side heat exchanger 6 was connected.

Figure 6:
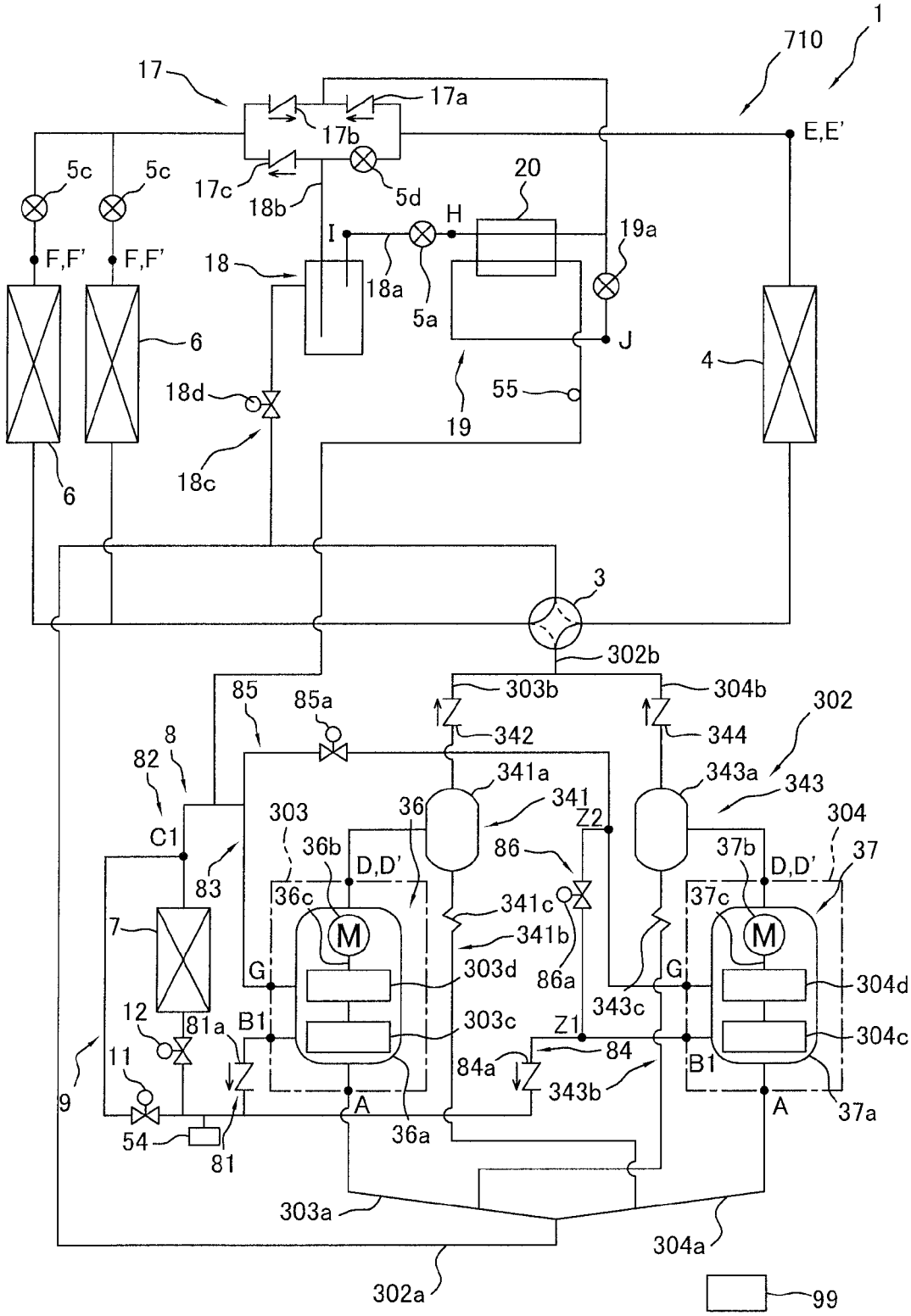
FIG. 6 is a schematic structural diagram of an air-conditioning apparatus according to Modification 1.

However, the present invention is not limited thereby; and a refrigerant circuit 710 is included in the present invention. As shown in FIG. 6, the refrigerant circuit 710 has a plurality of utilization-side heat exchanger 6. The utilization-side heat exchangers 6 can be individually started and stopped.

Specifically, the refrigerant circuit 510 (see FIG. 1) according to the embodiment described above in which a two-stage compression-type compression mechanism 2 is used may be fashioned into a refrigerant circuit 710 in which two utilization-side heat exchangers 6 are connected, utilization-side expansion mechanisms 5*c* are provided corresponding to the ends of the utilization-side heat exchangers 6 on the sides facing the bridge circuit 17, the receiver outlet expansion mechanism 5*b* previously provided to the receiver outlet pipe 18*b* is omitted, and a bridge outlet expansion mechanism 5*d* is provided instead of the outlet non-return valve 17*d* of the bridge circuit 17.

The configuration of the present embodiment has different actions during the air-cooling operation of the embodiment described above in that during the air-cooling operation, the bridge outlet expansion mechanism 5*d* is fully closed, and in place of the receiver outlet expansion mechanism 5*b* in the embodiment described above, the utilization-side expansion mechanisms 5*c* perform the action of further depressurizing the refrigerant already depressurized by the receiver inlet expansion mechanism 5*a* to a lower pressure before the refrigerant is fed to the utilization-side heat exchangers 6; but the other actions of the present modification are essentially the same as the actions during the air-cooling operations in the embodiment described above (FIGS. 1 through 3, as well as their relevant descriptions). The present embodiment also has different actions from those during the air-warming operation of the embodiment described above in that during the air-warming operation, the opening degrees of the utilization-side expansion mechanisms 5*c* are adjusted so as to control the quantity of refrigerant flowing through the utilization-side heat exchangers 6, and in place of the receiver outlet expansion mechanism 5*b*, the bridge outlet expansion mechanism 5*d* performs the action of further depressurizing the refrigerant already depressurized by the receiver inlet expansion mechanism 5*a* to a lower pressure before the refrigerant is fed to the heat source-side heat exchanger 4; but the other actions of the embodiment described above are essentially the same as the actions during the air-warming operations of the embodiment described above (FIGS. 1, 4, 5, and their relevant descriptions).

The same operational effects as those of the embodiment described above can also be achieved with the configuration of the present modification.

Though not described in detail herein, a compression mechanism having more stages than a two-stage compression system, such as a three-stage compression system, a four-stage compression system or another compression mechanism having multiple stages of more than two, may be used instead of the two-stage compression-type compression mechanisms 303, 304.

(4) Modification 2

With the refrigerant circuit 510 (see FIG. 1) in the embodiment described above, an example is given in which the refrigerant discharged from the first-stage compression element 303*c* and the refrigerant discharged from the first-stage compression element 304*c* merge at the merging point X, and branch off at the branch point Y, before being sucked into the second-stage compression element 303*d* and the second-stage compression element 304*d*, respectively.

Figure 7:
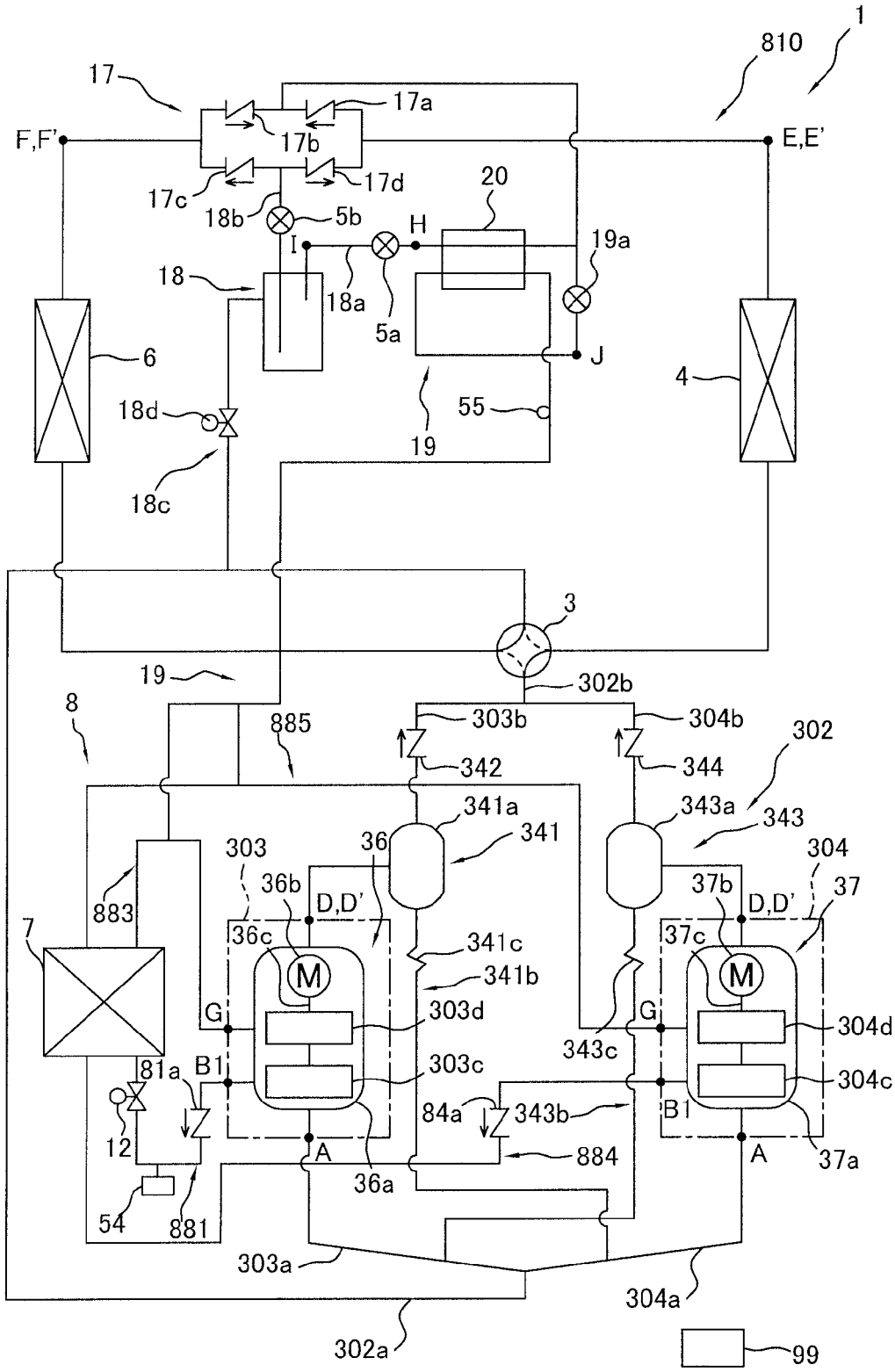
FIG. 7 is a schematic structural diagram of an air-conditioning apparatus according to Modification 2.

However, the present invention is not limited thereby, and it is possible to use, e.g., a refrigerant circuit 810 that is configured so that a merging point X and a branching point Y are not provided, but rather the refrigerant discharged from the first-stage compression element 303*c* and the refrigerant discharged from the first-stage compression element 304*c* are independently cooled in passage through the intercooler 7 without mixing, and are sucked into the second-stage compression element 303*d* and the second-stage compression element 304*d*, respectively, as shown in FIG. 7.

Specifically, the intermediate refrigerant pipe 8 may be configured so as to mainly have a first inlet-side intermediate branch pipe 881 connected to the discharge side of the first-stage compression element 303*c* of the first compression mechanism 303 and extending to the intercooler 7; a second inlet-side intermediate branch pipe 884 connected to the discharge side of the first-stage compression element 304*c* of the second compression mechanism 304 and extending to the intercooler 7; a first outlet-side intermediate branch pipe 883 having one end connected to the first inlet-side intermediate branch pipe 881 extending to the intercooler 7 and the other end connected to the intake side of the second-stage compression element 303*d* of the first compression mechanism 303; and a second outlet-side intermediate branch pipe 885 having one end connected to the second inlet-side intermediate branch pipe 884 extending to the intercooler 7 and the other end connected to the intake side of the second-stage compression element 304*d* of the second compression mechanism 304, as shown in FIG. 7.

In this case as well, the behavior of the T-S diagram and the T-H diagram varies, but the first compression mechanism 303 and the second compression mechanism 304 can still share usage of the intercooler 7.

(5) Modification 3

In the refrigerant circuit 510 (see FIG. 1) in the embodiment described above, an example is given in which the refrigerant discharged from the first-stage compression element 303*c* and the refrigerant discharged from the first-stage compression element 304*c* merge at the merging point X, and branch off at the branch point Y before being sucked into the second-stage compression element 303*d* and the second-stage compression element 304*d*, respectively.

Figure 8:
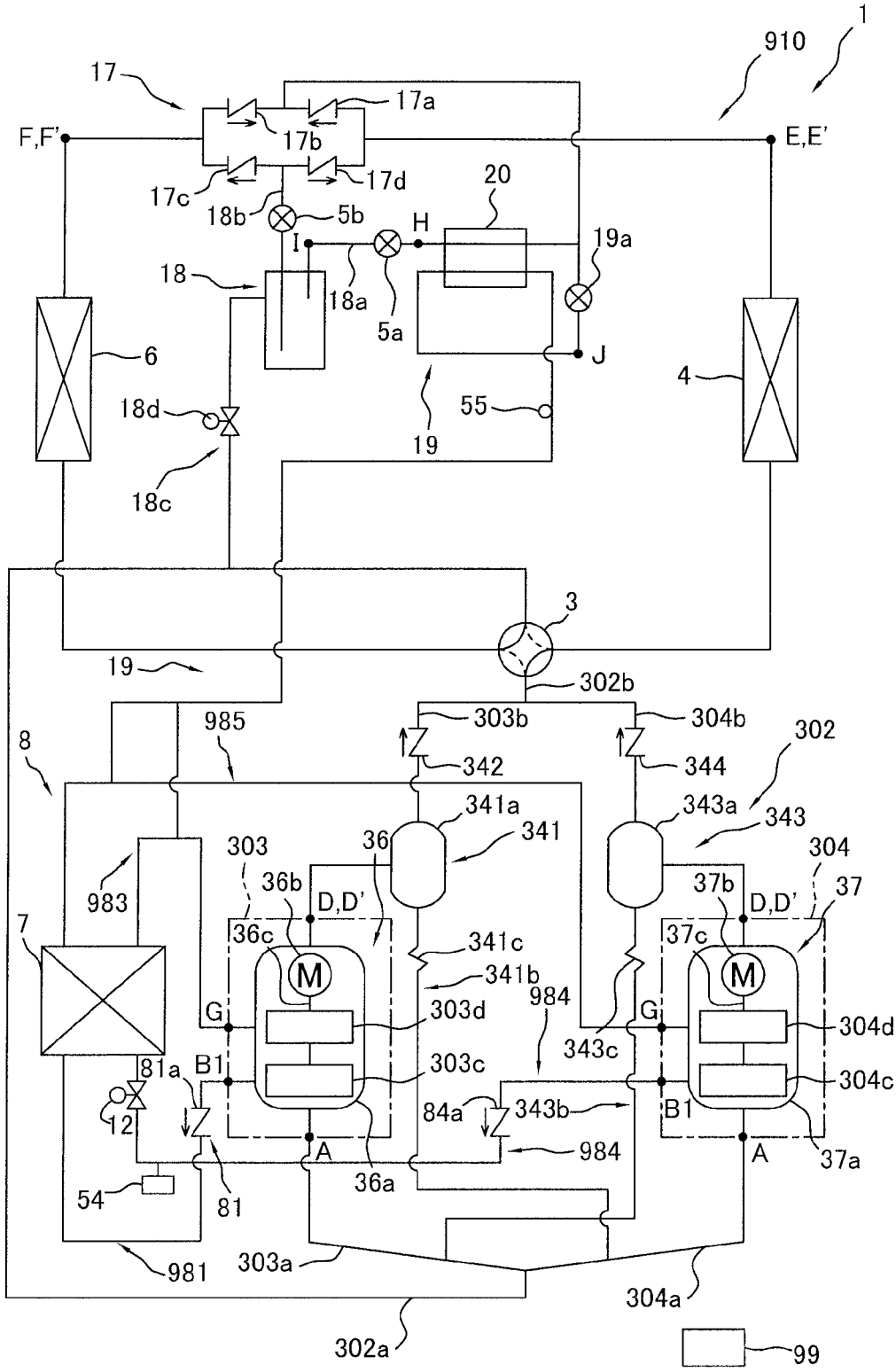
FIG. 8 is a schematic structural diagram of an air-conditioning apparatus according to Modification 3.

However, the present invention is not limited thereby, and it is possible to use, e.g., a refrigerant circuit 910 that is configured so that the flow of the refrigerant is connected between the first-stage side of one compressor and the second-stage side of another compressor, as shown in FIG. 8.

Specifically, a configuration is also possible in which the refrigerant discharged from the first-stage compression element 303*c* of the first compression mechanism 303 is sucked through the intercooler 7 into the second-stage compression element 304*d* of the second compression mechanism 304, and the refrigerant discharged from the first-stage compression element 304*c* of the second compression mechanism 304 passes through the intercooler 7, gets cooled, and is then sucked into the second-stage compression element 303*d* of the first compression mechanism 303.

Specifically, the intermediate refrigerant pipe 8 may be configured so as to mainly have a first inlet-side intermediate branch pipe 981 connected to the discharge side of the first-stage compression element 303*c* of the first compression mechanism 303 and extending to the intercooler 7; a second inlet-side intermediate branch pipe 984 connected to the discharge side of the first-stage compression element 304*c* of the second compression mechanism 304 and extending to the intercooler 7; a first outlet-side intermediate branch pipe 983 having one end extending to the intercooler 7 and connected to the second inlet-side intermediate branch pipe 984 via the intercooler 7 and the other end connected to the intake side of the second-stage compression element 303*d* of the first compression mechanism 303; and a second outlet-side intermediate branch pipe 985 having one end extending to the intercooler 7 and connected to the first inlet-side intermediate branch pipe 981 via the intercooler 7 and the other end connected to the intake side of the second-stage compression element 304*d* of the second compression mechanism 304, as shown in FIG. 8.

In this case as well, the behavior of the T-S diagram and the T-H diagram varies, but the first compression mechanism 303 and the second compression mechanism 304 can still share usage of the intercooler 7. The distribution balance of the refrigerant can be improved because the refrigerant flows so that refrigerant is connected between the compressors as described above.

(6) Modification 4

In the refrigerant circuit 510 (see FIG. 1) in the embodiment described above, an example is given in which the on/off valve 85*a* and the on/off valve 86*a* are set in a closed state (i.e., in a state in which the refrigerant does not flow through the second outlet-side intermediate branch pipe 85 and the startup bypass pipe 86) when the first compression mechanism 303 is started up.

However, the present invention is not limited thereby, and such control may also be carried out, e.g., directly prior to driving the second compression mechanism 304. Specifically, it is possible to set a state in which only the first compression mechanism 303 is started up with the on/off valve 85*a* and the on/off valve 86*a* left open, and the on/off valve 85*a* and the on/off valve 86*a* are thereafter closed just prior to starting up the second compression mechanism 304 (a predetermined length of time prior to starting up the second compression mechanism 304)

(7) Other Embodiments

Embodiments of the present invention and modifications thereof are described above with reference to the figures, but the specific configuration is not limited to these embodiments or their modifications, and can be changed within a range that does not deviate from the scope of the invention.

For example, in the above-described embodiment and modifications thereof, the present invention may be applied to a so-called chiller-type air-conditioning apparatus in which water or brine is used as a heating source or cooling source for conducting heat exchange with the refrigerant flowing through the utilization-side heat exchanger 6, and a secondary heat exchanger is provided for conducting heat exchange between indoor air and the water or brine that has undergone heat exchange in the utilization-side heat exchanger 6.

The present invention can also be applied to other types of refrigeration apparatuses besides the above-described chiller-type air-conditioning apparatus such as a dedicated air-cooling air-conditioning apparatus, or the like.

The refrigerant that operates in a critical range is not limited to carbon dioxide; ethylene, ethane, nitric oxide, and other gases may also be used.

INDUSTRIAL APPLICABILITY

The refrigeration apparatus of the present invention can increase the degree of freedom for adjusting the flow rate of refrigerant circulated by multistage compression-type compression elements and improve operating efficiency while suppressing an increase in the size of the apparatus in a refrigeration apparatus using a refrigerant that operates in a region including critical processes, and is therefore particularly useful when applied to a refrigeration apparatus provided with multistage-compression-type compression elements and using a refrigerant that operates in a region including critical processes as the operating refrigerant.

What is claimed is:

1. A refrigeration apparatus which uses a refrigerant that operates in a region including critical processes, the refrigeration apparatus comprising:

a compression mechanism including a first compressor having a first low-pressure compression element configured and arranged to increase pressure of the refrigerant and a first high-pressure compression element configured and arranged to increase pressure of the refrigerant more than the first low-pressure compression element, and a second compressor having a second low-pressure compression element configured and arranged to increase pressure of the refrigerant and a second high-pressure compression element configured and arranged to increase pressure of the refrigerant more than the second low-pressure compression element;

a heat-source-side heat exchanger configured and arranged to function as a heater or a cooler of the refrigerant;

an expansion mechanism configured and arranged to decompress the refrigerant;

a utilization-side heat exchanger configured and arranged to function as a heater or cooler of the refrigerant;

an intercooler configured and arranged to cool the refrigerant that passes therethrough; and an intermediate refrigerant pipe configured and arranged to cause refrigerant discharged from the first low-pressure compression element and the refrigerant discharged from the second low-pressure compression element to be sucked into the first high-pressure compression element and the second high-pressure compression element via the intercooler, the intake side of the second low-pressure compression element and the intake side of the first low-pressure compression element being connected; and the discharge side of the second high-pressure compression element and the discharge side of the first high-pressure compression element merging together.

2. The refrigeration apparatus according to claim 1, further comprising a merging circuit configured and arranged to merge and direct the refrigerant discharged from the first low-pressure compression element and the refrigerant discharged from the second low-pressure compression element to the intercooler; and a branching circuit configured and arranged to branch off and direct the refrigerant that has passed through the intercooler to the first high-pressure compression element and the second high-pressure compression element.

3. The refrigeration apparatus according to claim 1, further comprising a first intermediate refrigerant pipe configured and arranged to cause the refrigerant discharged from the first low-pressure compression element to pass through the intercooler and to be sucked into the first high-pressure compression element; and a second intermediate refrigerant pipe configured and arranged to cause the refrigerant discharged from the second low-pressure compression element to pass through the intercooler and to be sucked into the second high-pressure compression element.

4. The refrigeration apparatus according to claim 1, further comprising a first cross refrigerant pipe configured and arranged to cause the refrigerant discharged from the first low-pressure compression element to flow through the intercooler and to be sucked into the second high-pressure compression element; and a second cross refrigerant pipe configured and arranged to cause the refrigerant discharged from the second low-pressure compression element to flow through the intercooler and to be sucked into the first high-pressure compression element.

5. The refrigeration apparatus according to claim 1, wherein the first high-pressure compression element, the first low-pressure compression element, the second high-pressure compression element, and the second low-pressure compression element have rotating shafts that are rotatably driven to carry out compression work; and at least the rotating shaft of the first high-pressure compression element and the rotating shaft of the first low-pressure compression element are shared, or the rotating shaft of the second high-pressure compression element and the rotating shaft of the second low-pressure compression element are shared.

6. The refrigeration apparatus according to claim 1, further comprising an injection pipe configured and arranged to branch off the refrigerant fed from the heat-source-side heat exchanger or the utilization-side heat exchanger to the expansion mechanism, and to direct the refrigerant to the first high-pressure compression element and/or the second high-pressure compression element.

7. The refrigeration apparatus according to claim 6, further comprising an economizer heat exchanger configured and arranged to carry out heat exchange between the refrigerant fed from the heat-source-side heat exchanger or the utilization-side heat exchanger to the expansion mechanism, and the refrigerant that flows through the injection pipe.

8. The refrigeration apparatus according to claim 7, wherein the economizer heat exchanger has a conduit through which the refrigerant fed from the heat-source-side heat exchanger or the utilization-side heat exchanger to the expansion mechanism, and the refrigerant that flows through the injection pipe flow in opposing directions.

9. The refrigeration apparatus according to claim 7, wherein the injection pipe is further configured and arranged so as to branch off the refrigerant fed from the heat-source-side heat exchanger or the utilization-side heat exchanger to the expansion mechanism before the refrigerant fed from the heat-source-side heat exchanger or the utilization-side heat exchanger to the expansion mechanism undergoes heat exchange in the economizer heat exchanger.

10. The refrigeration apparatus (1) according to claim 6, wherein the injection pipe is further configured and arranged so that the refrigerant fed from the heat-source-side heat exchanger or the utilization-side heat exchanger to the expansion mechanism is branched off and guided between the intercooler and the first high-pressure compression element and/or the second high-pressure compression element.

11. The refrigeration apparatus according to claim 1, wherein the intercooler is a single intercooler that is part of the compression mechanism having the first compressor and the second compressor.

12. The refrigeration apparatus according to claim 1, further comprising a switching mechanism is further configured and arranged to switch between a cooling operation state in which the refrigerant is circulated through the compression mechanism, the heat-source-side heat exchanger, the expansion mechanism, and the utilization-side heat exchanger in sequence, and a heating operation state in which the refrigerant is circulated through the compression mechanism, the utilization-side heat exchanger, the expansion mechanism, and the heat-source-side heat exchanger in sequence; and intermediate cooling function-switching element configured and arranged to cause the intercooler to function as a cooler when the switching mechanism is in the cooling operation state, and to not allow the intercooler to function as a cooler when the switching mechanism in the heating operation state.

13. The refrigeration apparatus according to claim 1, wherein the refrigerant that operates in the region including critical processes is carbon dioxide.

14. The refrigeration apparatus according to claim 2, wherein the first high-pressure compression element, the first low-pressure compression element, the second high-pressure compression element, and the second low-pressure compression element have rotating shafts that are rotatably driven to carry out compression work; and at least the rotating shaft of the first high-pressure compression element and the rotating shaft of the first low-pressure compression element are shared, or the rotating shaft of the second high-pressure compression element and the rotating shaft of the second low-pressure compression element are shared.

15. The refrigeration apparatus according to claim 2, further comprising an injection pipe configured and arranged to branch off the refrigerant fed from the heat-source-side heat exchanger or the utilization-side heat exchanger to the expansion mechanism, and to direct the refrigerant to the first high-pressure compression element and/or the second high-pressure compression element.

16. The refrigeration apparatus according to claim 3, wherein the first high-pressure compression element, the first low-pressure compression element, the second high-pressure compression element, and the second low-pressure compression element have rotating shafts that are rotatably driven to carry out compression work; and at least the rotating shaft of the first high-pressure compression element and the rotating shaft of the first low-pressure compression element are shared, or the rotating shaft of the second high-pressure compression element and the rotating shaft of the second low-pressure compression element are shared.

17. The refrigeration apparatus according to claim 3, further comprising an injection pipe configured and arranged to branch off the refrigerant fed from the heat-source-side heat exchanger or the utilization-side heat exchanger to the expansion mechanism, and to direct the refrigerant to the first high-pressure compression element and/or the second high-pressure compression element.

18. The refrigeration apparatus according to claim 4, wherein the first high-pressure compression element, the first low-pressure compression element, the second high-pressure compression element, and the second low-pressure compression element have rotating shafts that are rotatably driven to carry out compression work; and at least the rotating shaft of the first high-pressure compression element and the rotating shaft of the first low-pressure compression element are shared, or the rotating shaft of the second high-pressure compression element and the rotating shaft of the second low-pressure compression element are shared.

19. The refrigeration apparatus according to claim 4, further comprising an injection pipe configured and arranged to branch off the refrigerant fed from the heat-source-side heat exchanger or the utilization-side heat exchanger to the expansion mechanism, and to direct the refrigerant to the first high-pressure compression element and/or the second high-pressure compression element.

20. The refrigeration apparatus according to claim 5, further comprising an injection pipe configured and arranged to branch off the refrigerant fed from the heat-source-side heat exchanger or the utilization-side heat exchanger to the expansion mechanism, and to direct the refrigerant to the first high-pressure compression element and/or the second high-pressure compression element.

* * * * *